US010386774B2

(12) United States Patent
Enomoto et al.

(10) Patent No.: US 10,386,774 B2
(45) Date of Patent: Aug. 20, 2019

(54) SHEET STACKER, IMAGE FORMING APPARATUS, AND SHEET CONVEYANCE CONTROL METHOD

(71) Applicants: Tadayasu Enomoto, Kanagawa (JP); Ryo Takenaka, Tokyo (JP); Daikai Zaitsu, Kanagawa (JP)

(72) Inventors: Tadayasu Enomoto, Kanagawa (JP); Ryo Takenaka, Tokyo (JP); Daikai Zaitsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/428,697

(22) Filed: Feb. 9, 2017

(65) Prior Publication Data

US 2017/0255155 A1 Sep. 7, 2017

(30) Foreign Application Priority Data

Mar. 4, 2016 (JP) ..... 2016-042368
Aug. 10, 2016 (JP) ..... 2016-157806

(51) Int. Cl.
*G03G 15/23* (2006.01)
*B65H 85/00* (2006.01)
(Continued)

(52) U.S. Cl.
CPC ..... *G03G 15/6552* (2013.01); *B65H 15/00* (2013.01); *B65H 85/00* (2013.01);
(Continued)

(58) Field of Classification Search
CPC ..... B65H 29/60; B65H 85/00; B65H 15/00; B65H 2402/33; B65H 2402/5152;
(Continued)

(56) References Cited

U.S. PATENT DOCUMENTS

2005/0084308 A1* 4/2005 Nakamura ..... G03G 15/50 399/407
2016/0363907 A1 12/2016 Enomoto et al.

FOREIGN PATENT DOCUMENTS

JP 5-201601 8/1993
JP 11-139659 5/1999
(Continued)

OTHER PUBLICATIONS

Machine translation of JP 11-139659, retrieved Sep. 28, 2017 (Year: 1999).*
(Continued)

*Primary Examiner* — Michael C McCullough
(74) *Attorney, Agent, or Firm* — Harness, Dickey & Pierce, P.L.C.

(57) ABSTRACT

A sheet stacker includes a sheet stack table on which a sheet is stacked and a sheet reversing section disposed above the sheet stack table. The sheet reversing section defines a sheet reverse passage to reverse a direction of conveyance of a sheet fed to the sheet reversing section. The sheet reversing section includes a first sheet guide to guide a bottom face of the sheet and a second sheet guide disposed downstream from the first sheet guide in a sheet conveyance direction in which the sheet is fed to the sheet reversing section. The second sheet guide to guide the bottom face of the sheet is attachable to and removable from an apparatus body.

4 Claims, 20 Drawing Sheets

(51) Int. Cl.
*G03G 15/00* (2006.01)
*B65H 15/00* (2006.01)

(52) U.S. Cl.
CPC ..... *G03G 15/234* (2013.01); *G03G 15/6573* (2013.01); *B65H 2402/63* (2013.01); *B65H 2404/61* (2013.01); *B65H 2404/691* (2013.01); *B65H 2405/31* (2013.01); *B65H 2801/06* (2013.01)

(58) Field of Classification Search
CPC ..... B65H 2402/5155; B65H 2405/31; G03G 15/234; G03G 2215/00421; G03G 2215/0043; G03G 2215/00434; G03G 2215/0054; G03G 2215/00544
See application file for complete search history.

(56) References Cited

FOREIGN PATENT DOCUMENTS

| | | |
|---|---|---|
| JP | 2006-069693 | 3/2006 |
| JP | 2007-248765 | 9/2007 |
| JP | 2008-037528 | 2/2008 |

OTHER PUBLICATIONS

Machine translation of JP 2008-37528, retrieved Sep. 28, 2017 (Year: 2008).*
Machine translation of JP 2008-037528, retrieved Mar. 9, 2018 (Year: 2008).*

* cited by examiner

SHEET STACKER, IMAGE FORMING APPARATUS, AND SHEET CONVEYANCE CONTROL METHOD

CROSS-REFERENCE TO RELATED APPLICATIONS

This patent application is based on and claims priority pursuant to 35 U.S.C. § 119(a) to Japanese Patent Application Nos. 2016-042368 filed, on Mar. 4, 2016, and 2016-157806 filed, on Aug. 10, 2016, in the Japan Patent Office, the entire disclosure of each of which is hereby incorporated by reference herein.

BACKGROUND

Technical Field

Embodiments of the present invention generally relate to a sheet stacker, an image forming apparatus, such as a copier, a printer, a facsimile machine, or a multifunction peripheral having at least two of copying, printing, facsimile transmission, plotting, and scanning capabilities, that includes the sheet stacker, and a sheet conveyance control method.

Description of the Related Art

There are sheet stackers that include a sheet stack table (i.e., an output sheet loading table) to accommodate sheets and a sheet reversing section located above the sheet stack table. The sheet reversing section is for reversing the direction of transport of the sheet.

SUMMARY

An embodiment of the present invention provides a sheet stacker that includes a sheet stack table on which a sheet is stacked and a sheet reversing section disposed above the sheet stack table. The sheet reversing section defines a sheet reverse passage to reverse a direction of conveyance of a sheet fed to the sheet reversing section. The sheet reversing section includes a first sheet guide to guide a bottom face of the sheet and a second sheet guide disposed downstream from the first sheet guide in a sheet conveyance direction in which the sheet is fed to the sheet reversing section. The second sheet guide is attachable to and removable from an apparatus body. The second sheet guide guides the bottom face of the sheet.

In another embodiment, an image forming apparatus includes an image forming device to form an image on a sheet, the sheet stack table described above, and the sheet reversing section described above.

In yet another embodiment, a sheet conveyance control method includes determining whether a job involves sheet feeding to the sheet reverse passage, detecting whether a guide cover to cover a sheet reverse passage is open when the job involves the sheet feeding to the sheet reverse passage, and inhibiting a sheet conveying operation when the guide cover being open is detected.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
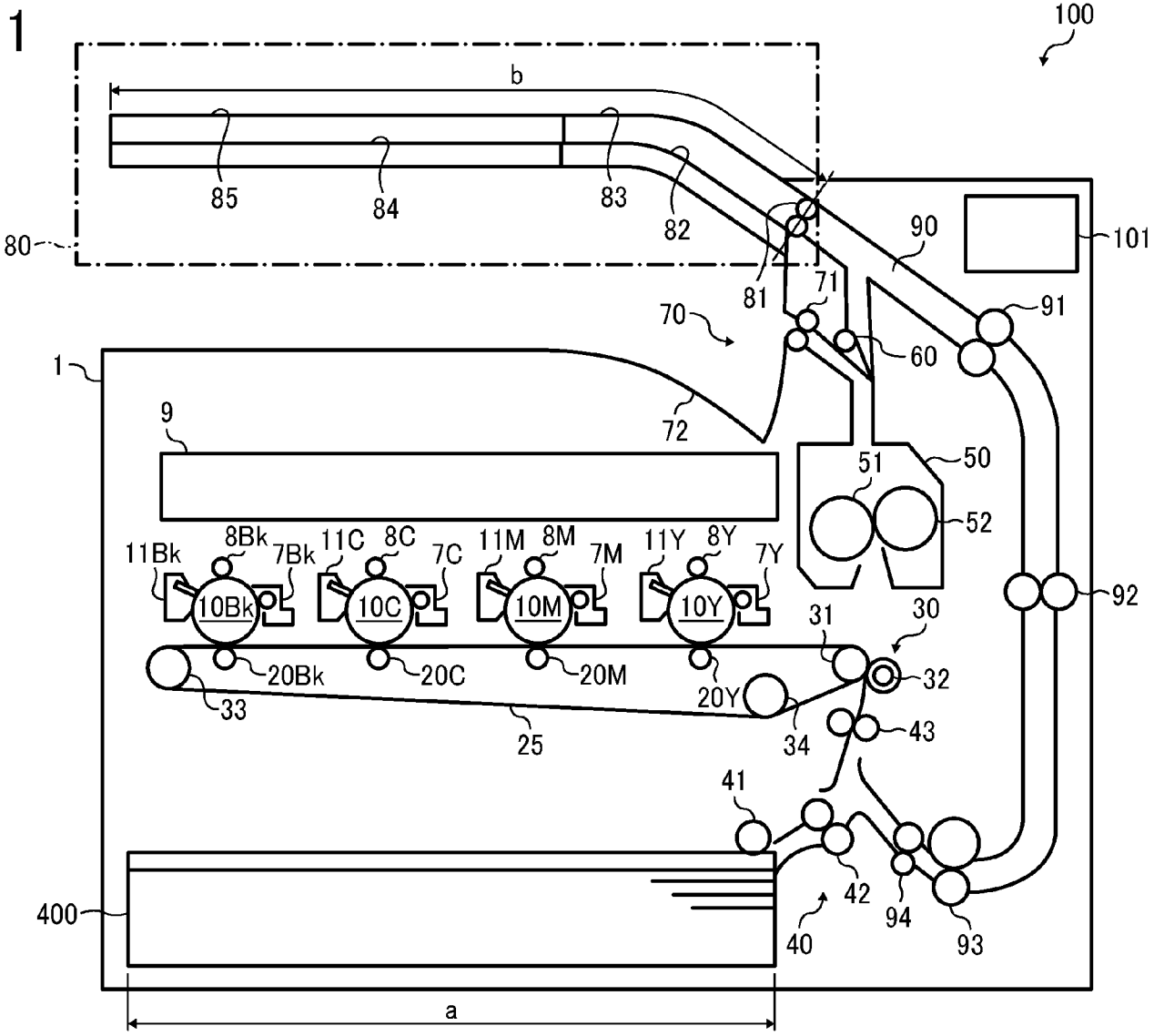
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise, The suffixes Y, M, C, and K attached to each reference numeral indicate only that components indicated thereby are used for forming yellow, magenta, cyan, and black images, respectively, and hereinafter may be omitted when color discrimination is not necessary.

A basic configuration of a printer 100, as an example of the image forming apparatus according to the present embodiment, is described below.

FIG. 1 is a schematic diagram illustrating the printer 100. The printer 100 includes photoconductor drums 10 (10Y, 10M, 10C, and 10Bk) disposed inside an apparatus body 1. The photoconductor drums 10 serve as image bearers. Black toner images, magenta toner images, cyan toner images, and yellow toner images are formed on the photoconductor drums 10Y, 10M, 10C, and 10Bk, respectively. The printer 100 further includes an intermediate transfer belt 25 disposed facing and in contact with the photoconductor drums 10Y, 10M, 10C, and 10Bk. The intermediate transfer belt 25 is looped taut around a driving roller 31, a driven roller 33, and a tension roller 34. The intermediate transfer belt 25 is rotatably supported by these rollers.

Regardless of the color of toner, the configuration and operation to form toner images on the photoconductor drums 10Y, 10M, 10C, and 10Bk are similar. Similarly, the configuration and operation to transfer the toner images onto the intermediate transfer belt 25 are similar regardless of the color of toner. Accordingly, a description is given of the configuration and operation to form black toner images on the photoconductor drum 10Bk and transfer black toner images onto the intermediate transfer belt 25. Descriptions of the configuration and operation regarding other colors are omitted to avoid redundancy.

The photoconductor drum 10Bk is rotated clockwise in FIG. 1, and a charging device 8Bk uniformly charges the surface of the photoconductor drum 10Bk in a negative polarity. Then, the charged surface of the photoconductor drum 10Bk is irradiated with writing light by an exposure device 9 to form an electrostatic latent image according to image data. As the photoconductor drum 10Bk rotates, the electrostatic latent image on the photoconductor drum 10Bk passes a developing range opposing a developing device 7Bk. Then, the electrostatic latent image is developed with black toner into a visible image. Primary transfer rollers 20 (20Y, 20M, 20C, and 20Bk) are disposed inside the looped intermediate transfer belt 25, facing the photoconductor drums 10Y, 10M, 10C, and 10Bk, respectively, via the intermediate transfer belt 25. The primary transfer roller 20Bk contacts the inner face of the intermediate transfer belt 25 to form a primary transfer nip between the photoconductor drum 10Bk and the intermediate transfer belt 25. The photoconductor drum 10 and the components disposed around the photoconductor drum 10 to perform the above-described image forming operation together serve as an image forming device, To the primary transfer roller 20Bk, a primary transfer voltage opposite in polarity to the toner image on the photoconductor drum 10Bk is applied. In the present embodiment, the primary transfer voltage is in a plus (positive) polarity. Thus, a transfer electrical field is generated between the photoconductor drum 10Bk and the intermediate transfer belt 25, and, in the primary image transfer, the toner image on the photoconductor drum 10Bk is electrically transferred onto the intermediate transfer belt 25 that rotates in synchronization with the photoconductor drum 10Bk. After the toner image is primarily transferred onto the intermediate transfer belt 25, a cleaning device 11Bk removes residual toner remaining on the surface of the photoconductor drum 10Bk.

Similarly, a cyan toner image, a magenta toner image, and a yellow toner image are respectively formed on the photoconductor drums 10Y, 10M, and 10C, and the toner images of respective colors are sequentially superimposed one after another on the black toner image on the intermediate transfer belt 25.

Disposed in a lower section of the apparatus body 1 are a sheet tray 400 to contain sheets P and a sheet feeder 40 to feed the sheets P from the sheet tray 400 to an image forming section. As a sheet feeding roller 41 of the sheet feeder 40 rotates, the sheet P on the top in the sheet tray 400 is sent out. Then, a conveyance roller pair 42 transports the sheet P to a registration roller pair 43. Then, the registration roller pair 43 forwards the sheet P at a predetermined timing to a secondary transfer nip, in which a portion of the intermediate transfer belt 25 looped around the driving roller 31 contacts a secondary transfer roller 32 of a secondary transfer device 30. At that time, a predetermined secondary transfer voltage is applied to the secondary transfer roller 32 to generate a secondary transfer electrical field between the intermediate transfer belt 25 and the secondary transfer roller 32, and the toner image is secondarily transferred from the intermediate transfer belt 25 onto the sheet P.

The sheet P bearing the toner image is transported to a fixing device 50 disposed above the secondary transfer nip in FIG. 1. The fixing device 50 includes a fixing roller 51 and a heating roller 52 disposed in contact with each other, forming a fixing nip. The fixing device 50 fixes the toner image on the sheet with heat and pressure while the sheet P passes through the fixing nip.

Then, the sheet P having the toner image fixed thereon is discharged through a discharge path located in an upper section of the apparatus body 1. In single-side image formation to form an image on one side of the sheet P, a switching claw 60 switches the route of the sheet P to a route leading to a sheet ejection section 70. The sheet ejection section 70 includes an ejection roller pair 71 and an output tray 72 (i.e., a sheet stack table). The ejection roller pair 71 discharges the sheet P from the sheet ejection section 70, through a sheet outlet, onto the output tray 72. The discharged sheets P are sequentially stacked on the output tray 72.

Above the output tray 72, a sheet reversing section 80 including a reversing tray 82 (i.e., a first sheet guide) and an extension tray 84 (i.e., a second sheet guide) is disposed. The reversing tray 82 and the extension tray 84 guide the bottom face of the sheet P reversed by a reversing roller pair 81. In FIG. 1, a distance b extends from the reversing roller pair 81 to an end face of the extension tray 84 in a sheet conveyance direction in which the sheet P is transported in the sheet reversing section 80. The distance b is longer than a length a of the sheet tray 400 in the sheet conveyance direction. The end face of the extension tray 84 is aligned with an end face of the apparatus body 1 in a vertical direction to eliminate the necessity of moving the apparatus body 1 even when the installation space is small. An upper side of the reversing tray 82 is covered with a reversing-tray cover 83, and an upper side of the extension tray 84 is covered with an extension-tray cover 85. The extension tray 84 and the extension-tray cover 85 are disposed downstream from the reversing tray 82 and the reversing-tray cover 83, respectively, in the direction in which the sheet P enters the reversing tray 82. The extension tray 84 and the extension-tray cover 85 are in contact with L-shaped two faces formed by a side plate 1*a* (illustrated in FIG. 5) of the apparatus body 1 and downstream end faces of the reversing tray 82 and the reversing-tray cover 83 in the sheet conveyance direction. The side plate 1*a* is parallel to the sheet ejection direction in the sheet ejection section 70 of the apparatus body 1. The reversing tray 82 and the reversing-tray cover 83 are secured (may be fixed) to the apparatus body 1. The extension tray 84 and the extension-tray cover 85 are removably attached to the apparatus body 1.

Figure 2:
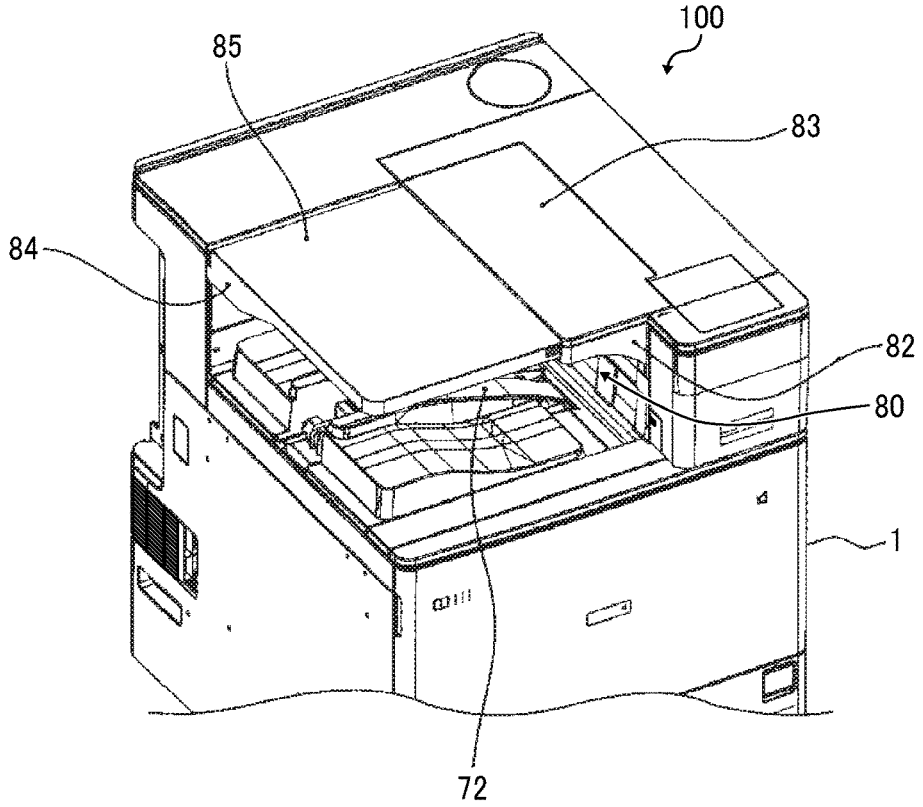
FIG. 2 is a perspective view illustrating an exterior of the image forming apparatus illustrated in FIG. 1.

It is to be noted that, as illustrated in FIG. 2, when the reversing-tray cover 83 and the extension-tray cover 85 of the sheet reversing section 80 are coplanar with upper faces of other portions of the printer 100, the height of the printer 100 is reduced, and the printer 100 is compact.

Figure 3:
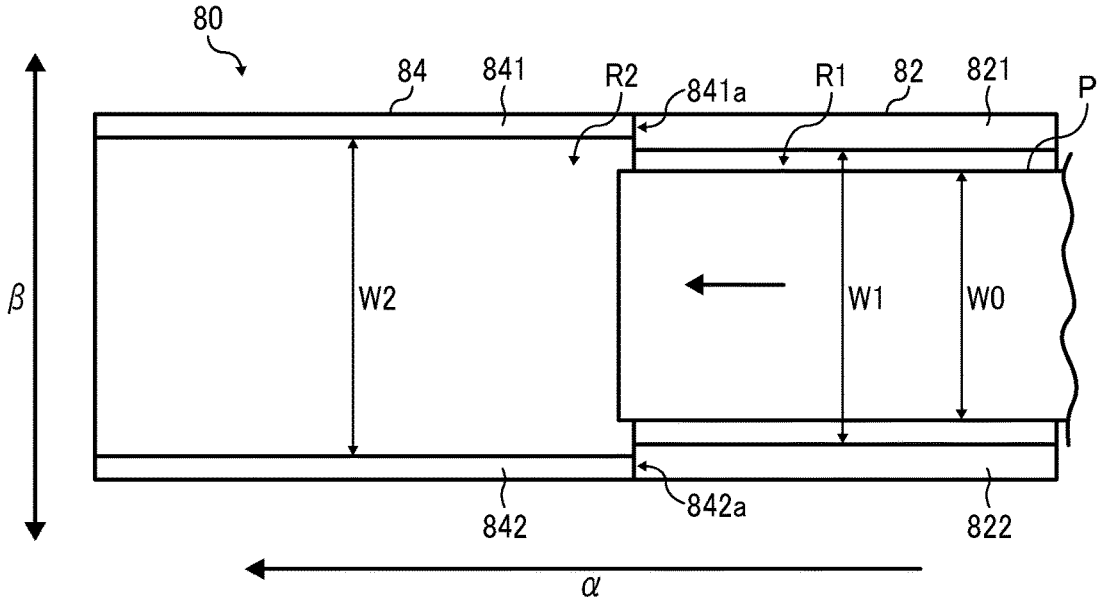
FIG. 3 is a plan view illustrating widths of a sheet reverse passage in a sheet reversing section according to an embodiment.

FIG. 3 is a diagram illustrating widths of a sheet reverse passage in the sheet reversing section 80.

In FIG. 3 and subsequent drawings, arrow a represents the sheet conveyance direction (hereinafter "sheet conveyance direction α"), and arrow β represents a sheet width direction (hereinafter "sheet width direction β") perpendicular to the sheet conveyance direction α. In the sheet reversing section 80, the sheet P is reversed through the sheet reverse passage including an upstream reverse passage R1 defined by the reversing tray 82 and the reversing-tray cover 83 and a downstream reverse passage R2 defined by the extension tray 84 and the extension-tray cover 85. The upstream reverse passage R1 has a width W1 (i.e., the length in the sheet width direction β) greater than a width W0, which is a distance between inner faces of a side plate 821 and a side plate 822 disposed on both sides of the reversing tray 82 in the sheet width direction β. The width W0 is equivalent to a largest sheet width usable in the printer 100. A width W2 of the downstream reverse passage R2 is a distance between inner faces of a side plate 841 and a side plate 842 disposed on both sides of the extension tray 84 in the sheet width direction β. The width W2 is greater than the width WI of the upstream reverse passage R1. This structure inhibits the end of the sheet P from getting caught on an end face 841*a* of the side plate 841 and an end face 842*a* of the side plate 842 in the sheet conveyance direction α. Thus, defective sheet conveyance can be inhibited. In another embodiment, a connected portion between the upstream reverse passage R1 and the downstream reverse passage R2 are designed such that the width of the sheet reverse passage gradually increases toward the downstream reverse passage R2.

Figure 4:
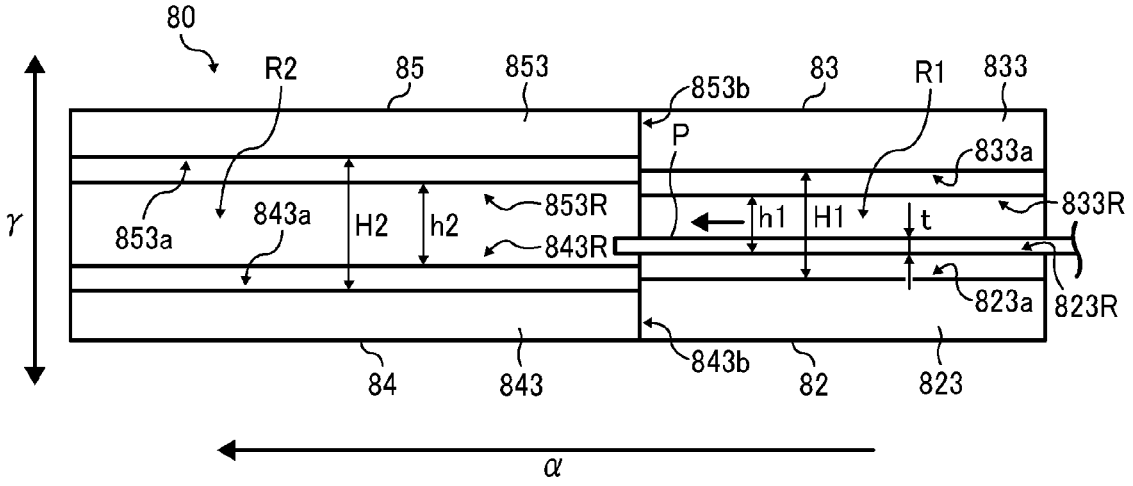
FIG. 4 is a diagram illustrating heights of the sheet reverse passage in the sheet reversing section illustrated in FIG. 3.

FIG. 4 is a diagram illustrating heights of the sheet conveyance passage in the sheet reversing section 80.

In FIG. 4, arrow γ represents the direction of height (hereinafter "height direction γ") of the sheet reversing section 80. The reversing tray 82 includes a guide plate 823 having a sheet opposing face 823*a* to oppose the sheet P. The reversing-tray cover 83 includes an upper plate 833 having a sheet opposing face 833*a* to oppose the sheet P. A height H1 of the upstream reverse passage R1, which is a distance between the sheet opposing face 823*a* and the sheet opposing face 833*a*, is greater than a largest sheet thickness t usable in the printer 100. The extension tray 84 includes a guide plate 843 having a sheet opposing face 843*a* to oppose the sheet P. The extension-tray cover 85 includes an upper plate 853 having a sheet opposing face 853*a* to oppose the sheet P. A height H2 between the sheet opposing face 843*a* and the sheet opposing face 853*a* is greater than the height H1 of the upstream reverse passage R1. The sheet opposing face 843*a* of the guide plate 843 is lower than the sheet opposing face 823*a* of the guide plate 823. The sheet opposing face 853*a* of the upper plate 853 is higher than the sheet opposing face 833*a* of the upper plate 833. This structure inhibits the end of the sheet P from getting caught on an end face 843*b* of the guide plate 843 and an end face 853*b* of the upper plate 853 in the sheet conveyance direction α. Thus, defective sheet conveyance can be inhibited.

In each of the reversing tray 82, the reversing-tray cover 83, the extension tray 84, and the extension-tray cover 85, each of the sheet opposing faces 823*a*, 833*a*, 843*a*, and 853*a* can have a ragged shape (e.g., with a projection or a recess). An example of the ragged shape is formed by multiple ribs 865 illustrated in FIGS. 9 through 10B. The ribs 865, each of which extends in the sheet conveyance direction α, are disposed on each of the sheet opposing faces 823*a*, 833*a*, 843*a*, and 853*a* and arranged side by side in the sheet width direction β perpendicular to the sheet conveyance direction α. This structure can reduce the area of contact, with the sheet P, of each of the reversing tray 82, the reversing-tray cover 83, the extension tray 84, and the extension-tray cover 85 compared with a case where such ribs are not provided. Then, the resistance against sheet conveyance can be reduced to improve sheet conveyance. In another embodiment, not all of the sheet opposing faces 823*a*, 833*a*, 843*a*, and 853*a*, but at least one of the sheet opposing faces 823*a*, 833*a*, 843*a*, and 853*a* includes the ribs 865.

In FIG. 4, a height h1 is a distance between a rib end 823R of the reversing tray 82 and a rib end 833R of the reversing-tray cover 83 in the configuration including the ribs 865, and the height h1 is greater than the largest sheet thickness t usable in the printer 100. Additionally, a height h2 of the downstream reverse passage R2, which is a distance between a rib end 843R of the extension tray 84 and a rib end 853R of the extension-tray cover 85, is greater than the height h1 of the upstream reverse passage R1. The rib end 843R of the extension tray 84 is positioned lower than the rib end 823R of the reversing tray 82. The rib end 853R of the extension-tray cover 85 is positioned higher than the rib end 833R of the reversing-tray cover 83. With this structure, when the sheet P enters the downstream reverse passage R2 from the upstream reverse passage R1, the end of the sheet P is inhibited from being caught on an end face of the rib 865 in the sheet conveyance direction α. Thus, defective sheet conveyance can be inhibited.

In double-side image formation, the switching claw 60 illustrated in FIG. 1 switches the route of sheet conveyance to transport the sheet P bearing an image on one side to the sheet reversing section 80 including the reversing tray 82, the reversing-tray cover 83, the extension tray 84, and the extension-tray cover 85. By contrast, the sheet P bearing images on both sides thereof is transported to the sheet ejection section 70. Specifically, in the sheet reversing section 80, while clamping the trailing end of the sheet P, the reversing roller pair 81 temporarily discharges the sheet P through a reverse outlet onto the reversing tray 82 and the extension tray 84. Subsequently, the reversing roller pair 81 is rotated in reverse, with a motor to drive the reversing roller pair 81, to feed the sheet P to a re-feed passage 90. Then, the sheet P is fed via conveyance roller pairs 91, 92, 93, and 94 and the registration roller pair 43 to the transfer section, and an image is secondarily transferred from the intermediate transfer belt 25 onto a back side (second side) of the sheet P.

Thus, the sheet reversing section 80 has a length to guide the bottom face of the sheet P and cover the upper side of the sheet P in the entire sheet length even in reversing long sheets such as A3-size sheets and double-letter (DLT) size sheets. By contrast, if the length of the sheet reversing section 80 is too long in the sheet conveyance direction α, the area of the sheets discharged on the output tray 72 increases to the degree to cause inconveniences. Accordingly, the extension tray 84 and the extension-tray cover 85 are removable from the apparatus body 1 to adjust the length to guide the bottom face of the sheet P and cover the upper side of the sheet P.

Figure 5:
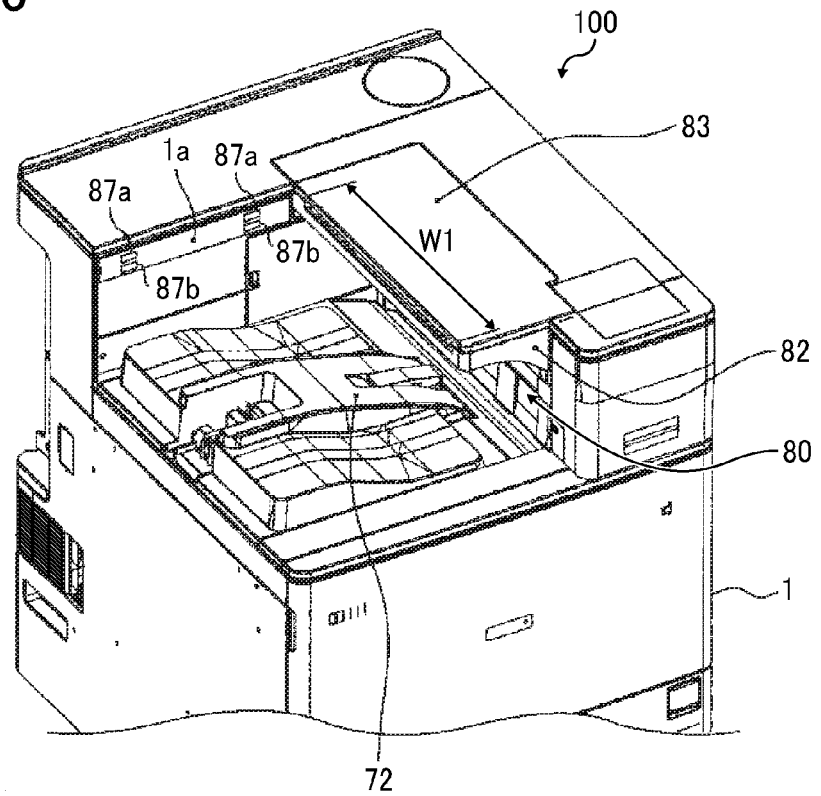
FIG. 5 is a perspective view illustrating the exterior of the image forming apparatus in a state in which an extension tray and an extension-tray cover are removed therefrom.

FIG. 5 is a perspective view illustrating an exterior of the printer 100 in a state in which the extension tray 84 and the extension-tray cover 85 are removed therefrom.

The side plate 1*a* (illustrated in FIG. 5) includes insertion recesses 87*a* on which the extension tray 84 and the extension-tray cover 85 are hooked. The side plate 1*a* is parallel to the sheet ejection direction in the sheet ejection section 70 and on the right of the apparatus body 1 when viewed from upstream to downstream in the sheet ejection direction. Below the insertion recesses 87*a*, through holes 87*b* are formed in the side plate 1*a*.

Figure 6:
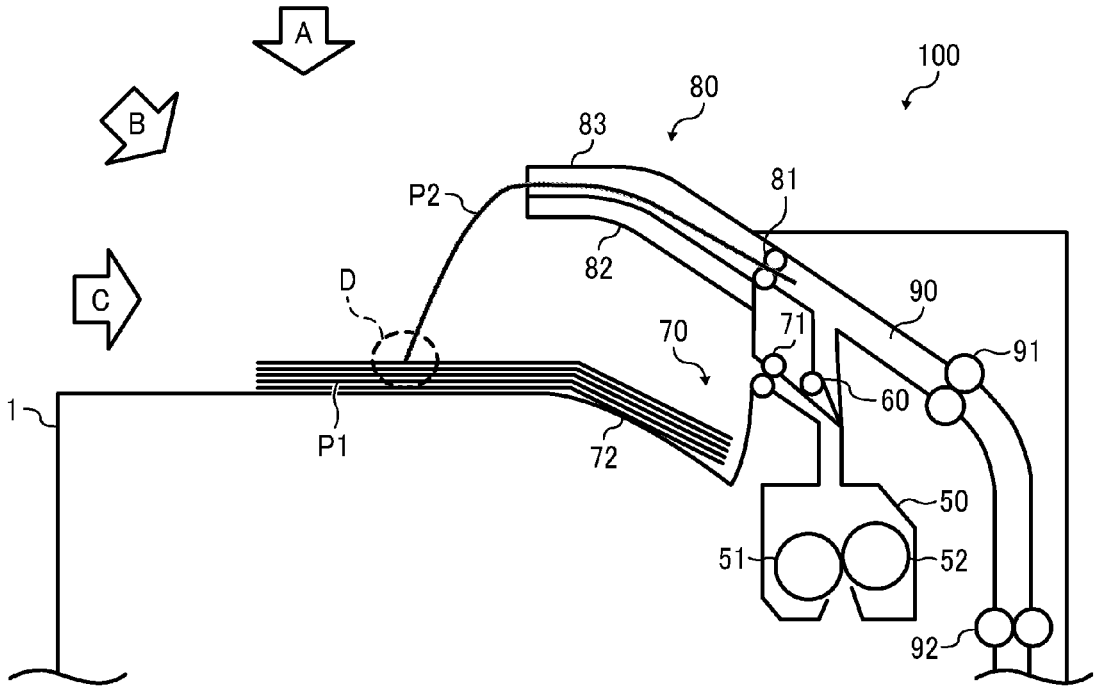
FIG. 6 is an enlarged cross-sectional view of the sheet reversing section in a state in which the extension tray and the extension-tray cover are removed and a long sheet is transported to the sheet reversing section.

FIG. 6 is an enlarged view illustrating the sheet reversing section 80 and the adjacent portion in the state in which the extension tray 84 and the extension-tray cover 85 are removed from the apparatus body 1.

As illustrated in FIG. 6, in the state in which the extension tray 84 and the extension-tray cover 85 are removed from the apparatus body 1, if the length of a reversed sheet P2 is longer than the length of the reversing tray 82 in the sheet conveyance direction α, the leading side of the reversed sheet P2 is undesirably draped from the reversing tray 82. Accordingly, the leading side of the reversed sheet P2 may contact sheets P1 discharged on the output tray 72 as indicated by broken circle D in FIG. 6. In such a case, the reversed sheet P2 may disturb alignment of the sheets P1 or push the sheets P1 out from the output tray 72.

Figure 7:
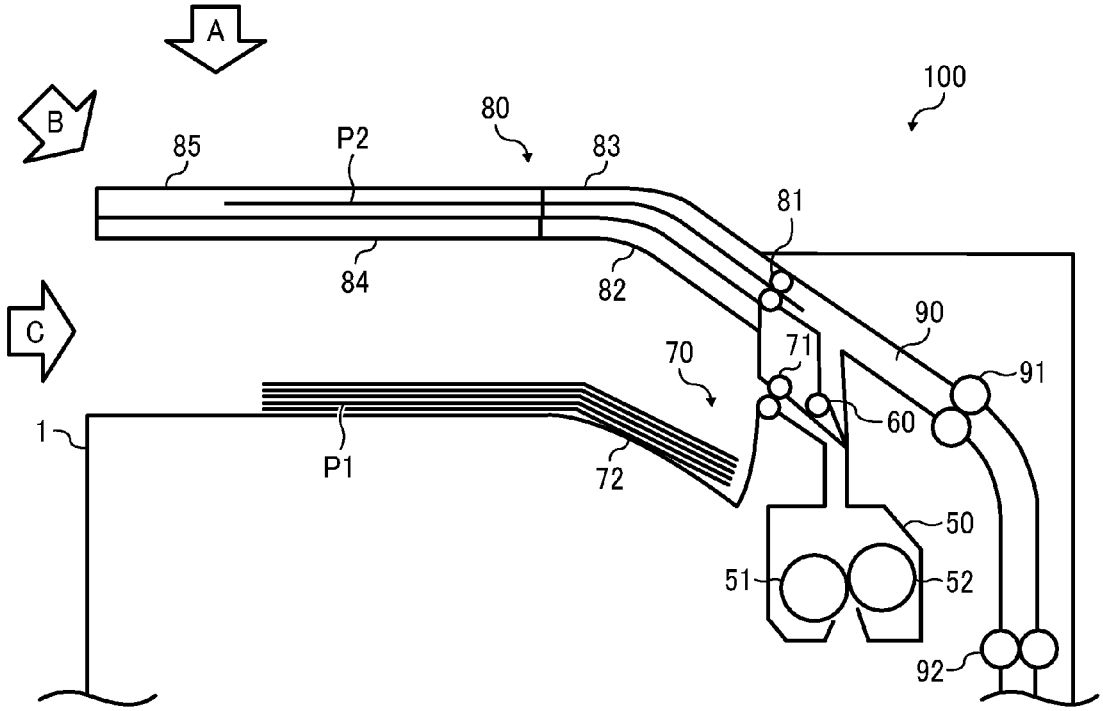
FIG. 7 is an enlarged view of the sheet reversing section in a state in which the extension tray and the extension-tray cover are attached thereto and a long sheet is transported thereto.

FIG. 7 is an enlarged view illustrating the sheet reversing section 80 and the adjacent portion in a state in which the extension tray 84 and the extension-tray cover 85 are attached to the apparatus body 1.

In FIG. 7, the reversed sheet P2 transported in the sheet reversing section 80 is longer than the reversing tray 82 in the sheet conveyance direction α. As illustrated in FIG. 7, in the state in which the extension tray 84 and the extension-tray cover 85 are attached to the apparatus body 1, the sheet reversing section 80 is extended in the sheet conveyance direction α, compared with the state illustrated in FIG. 6. Accordingly, the entire bottom face of the reversed sheet P2 being reversed can be guided by the reversing tray 82 and the extension tray 84, and the leading side of the reversed sheet P2 is not draped from the reversing tray 82. Then, alignment of discharged sheets is not disturbed.

In FIG. 6, the leading side of the reversed sheet P2 is exposed from the reversing tray 82 and the reversing-tray cover 83. Accordingly, there is a risk that a user may pull out the sheet P2 being reversed in the sheet reversing section 80. If the user pulls out the sheet P2 being reversed in the sheet reversing section 80, the printer 100 can determine that defective sheet conveyance, such as paper jam (i.e., sheet jam), has occurred in the route of sheet conveyance and cause unexpected jamming. In the case of high-speed image forming apparatus capable of image formation on a large number of sheets per unit time, the speed of sheet conveyance in reverse is also high. Therefore, the user may feel uncomfortable seeing the sheet P2 bursting out at high speed from the reversing tray 82 or the reversing-tray cover 83.

By contrast, when the extension tray 84 and the extension-tray cover 85 are attached to the apparatus body 1 as illustrated in FIG. 7, the sheet P2 being reversed in the sheet reversing section 80 is hidden from the user. Accordingly, there is no chance for the user to pull out the sheet P2 being reversed in the sheet reversing section 80, and paper jam caused thereby is inhibited. Since the leading side of the sheet P2 is not exposed from the sheet reversing section 80, the user is inhibited from seeing the sheet P2 bursting out at high speed and feeling uncomfortable.

In the structure illustrated in FIG. 6, the discharged sheets P1 on the output tray 72 are visible and taken out from any of directions indicated by arrows A, B, and C. By contrast, in the state illustrated in FIG. 7, in which the extension tray 84 and the extension-tray cover 85 are attached to the apparatus body 1, in the direction from above the sheet reversing section 80, indicated by arrow A, visibility of the sheets P1 on the output tray 72 is degraded and removal of the sheets P1 is not easy. Further, as illustrated in FIG. 7, if the sheets P1 are shorter than the sum of the length of the reversing tray 82 and the length of the extension tray 84 covering the space above the output tray 72, removal of the sheets P1 from the directions indicated by arrows B and C are hindered.

In view of the foregoing, unless long sheets such as A3-size and DLT size are fed, the extension tray 84 and the extension-tray cover 85 are removed from the apparatus body 1. Then, compared with the state in which the extension tray 84 and the extension-tray cover 85 are attached to the apparatus body 1, the area of the output tray 72 covered with the sheet reversing section 80 is reduced. Accordingly, the visibility of the sheets P1 on the output tray 72 and ease of removal of the sheets P1 therefrom can be improved. In one embodiment, the printer 100 further includes a sensor to detect whether the extension tray 84 and the extension-tray cover 85 are attached to the minter 100. When the sensor detects that the attached extension tray 84 and the attached extension-tray cover 85 are attached thereto, a controller 101 of the printer 100 determines that A3-size sheets or DLT-size sheets can be fed from the sheet tray 400 and causes a display to indicate that operation is feasible. The display can be attached to the apparatus body 1 or included in a control panel that communicates with the apparatus body 1. When the extension tray 84 and the extension-tray cover 85 are removed from the apparatus body 1, the controller 101 inhibits feeding of long sheets from the sheet tray 400 and causes the display to indicate that operation is not feasible.

Figure 8:
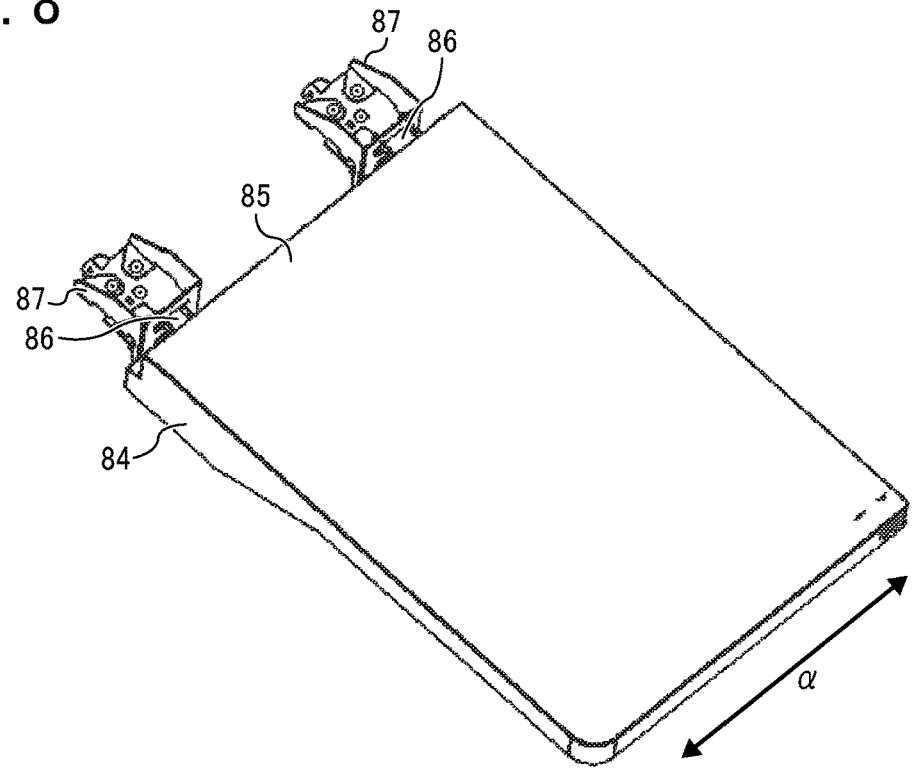
FIG. 8 is a schematic view of coupling parts to attach the extension tray and the extension-tray cover to an apparatus body.

FIG. 8 is a schematic view of a first coupling portion to attach the extension tray 84 and the extension-tray cover 85 to the apparatus body 1.

The extension tray 84 and the extension-tray cover 85 are united with each other by screws. Coupling parts 86 are disposed on the extension tray 84, one at each of two positions in the sheet conveyance direction α. Alternatively, the coupling parts 86 can be disposed on the extension-tray cover 85. The number of the coupling parts 86 is not limited to two but can be three or greater. In a configuration in which the multiple coupling parts 86 are disposed on either the extension tray 84 or the extension-tray cover 85, it is preferred that the coupling parts 86 are aligned in the sheet conveyance direction α. On the side plate 1*a*, which is parallel to the sheet ejection direction in the sheet ejection section 70 and illustrated in FIG. 5, two coupling parts 87 to engage the coupling parts 86 of the extension tray 84, respectively, are disposed. That is, one coupling part 87 is disposed at each of two positions on the side plate 1*a* in the sheet ejection direction. As each of the coupling parts 86 engages with the corresponding one of the coupling parts 87, the extension tray 84 and the extension-tray cover 85 are attached to the apparatus body 1.

Hereinafter the side of the extension tray 84 or e extension-tray cover 85 on which the coupling parts 86 are disposed is referred to as "attachment side". In the present embodiment, the extension-tray cover 85 is thicker on the attachment side than on the other side in the sheet width direction β. This structure increases the rigidity of the attachment side of the extension-tray cover 85, which becomes a base when the extension tray 84 and the extension-tray cover 85 are attached to the apparatus body 1, from the rigidity of the other side. Then, the extension tray 84 and the extension-tray cover 85 are inhibited from sagging.

Figure 9:
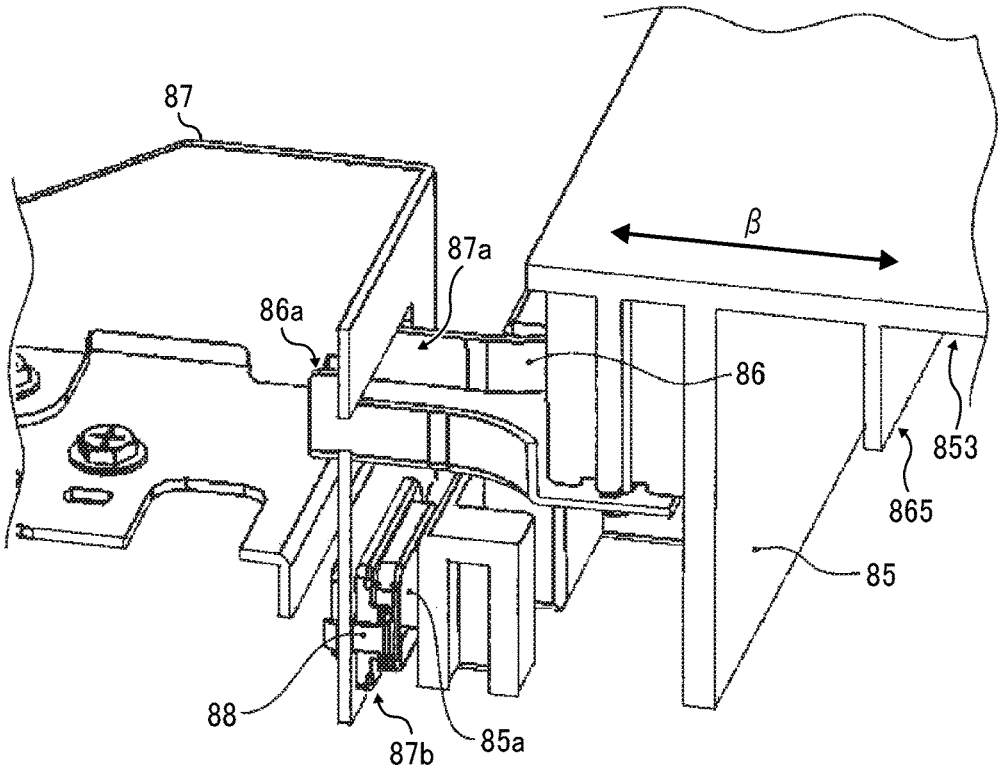
FIG. 9 is a perspective view illustrating a cross-sectional shape of a first coupling portion between the extension tray and an apparatus body according to an embodiment.

FIG. 9 is a perspective view illustrating a cross-sectional shape of the first coupling portion between the extension tray 84 and the apparatus body 1 (with the coupling part 86 and the coupling part 87).

The coupling part 86 includes a hook portion 86*a*. The coupling part 86 is screwed to the extension-tray cover 85 with the hook portion 86*a* projecting beyond the end face of the extension-tray cover 85 in the sheet width direction β. Below the hook portion 86*a* of the extension-tray cover 85, a positioning projection 85*a* projecting from the end face in the sheet width direction β is disposed. By contrast, the coupling part 87, disposed on the side plate 1*a* of the apparatus body 1, includes the insertion recess 87*a*, in which the hook portion 86*a* is hooked. The coupling part 87 further includes the through hole 87*b* below the insertion recess 87*a*, and the positioning projection 85*a* is inserted into the through hole 87*b*.

Figure 10A:
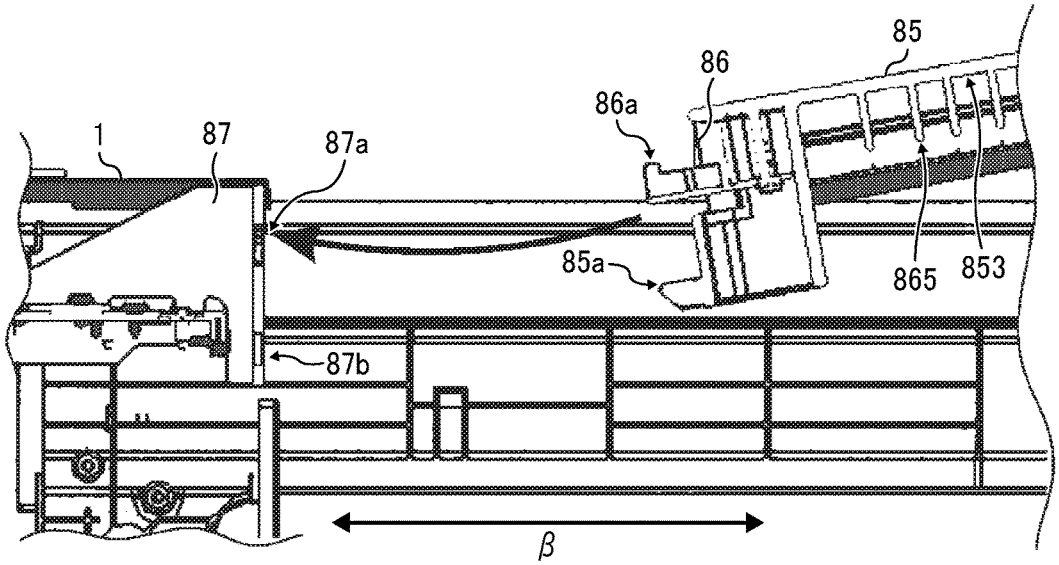
FIGS. 10A and 10B are schematic views illustrating attaching of the extension tray and the extension-tray cover to the apparatus body.
Figure 10B:
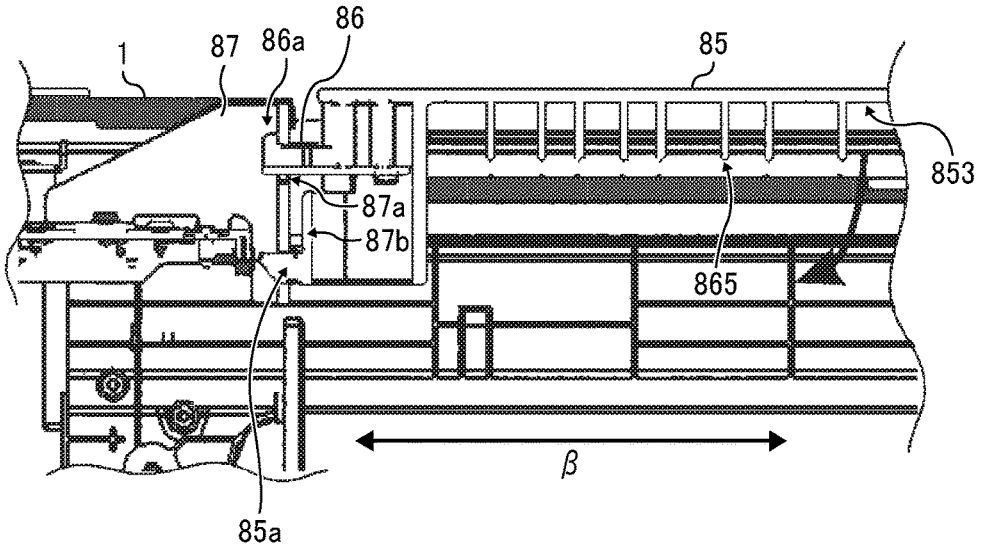

FIGS. 10A and 10B are schematic views illustrating attaching of the extension tray 84 and the extension-tray cover 85 to the apparatus body 1.

To attach the extension tray 84 and the extension-tray cover 85, the hook portions 86*a* of the coupling parts 86 are inserted into the insertion recesses 87*a* of the coupling parts 87, and the extension tray 84 and the extension-tray cover 85 are rotated down in that state. Then, the positioning projections 85*a* of the extension-tray cover 85 are inserted into the through holes 87*b* of the coupling parts 87, and the hook portions 86*a* of the coupling parts 86 are hooked on rims of the insertion recesses 87*a* of the coupling parts 87. Then, attachment of the extension tray 84 and the extension-tray cover 85 to the apparatus body 1 is completed. Thus, the extension tray 84 and the extension-tray cover 85 are easily attached to the apparatus body 1 without using a tool. It is to be noted that, as the positioning projections 85*a* are inserted into the through holes 87*b*, position of the extension-tray cover 85 is determined relative to the apparatus body 1. In the present embodiment, a slide aid 88 (illustrated in FIG. 9) is attached to the rim of the through hole 87*b* to cover the rim of the through hole 87*b* to improve sliding of the positioning projection 85*a* into and out from the through hole 87*b*. For example, the slide aid 88 can be made of resin such as polyacetal (POM).

The above-described operation is performed in reversed to remove the extension tray 84 and the extension-tray cover 85 from the apparatus body 1. Thus, the extension tray 84 and the extension-tray cover 85 are easily removed from the apparatus body 1 without using a tool. It is preferable that the extension tray 84 and the extension-tray cover 85 removed from the apparatus body 1 are stored near the printer 100. Accordingly, for example, the exterior cover of the apparatus body 1 includes hook recesses on which the hook portion 86*a* are hooked or holes into which the positioning projections 85*a* are inserted. Alternatively, in a configuration including multiple sheet trays 400, the extension tray 84 and the extension-tray cover 85 are stored in the sheet tray 400 to accommodate the long sheet size such as A3 size or DLT size. Then, the extension tray 84 and the extension-tray cover 85 removed from the apparatus body 1 can be held on the exterior cover of the apparatus body 1 or stored inside the apparatus body 1.

Figure 11A:
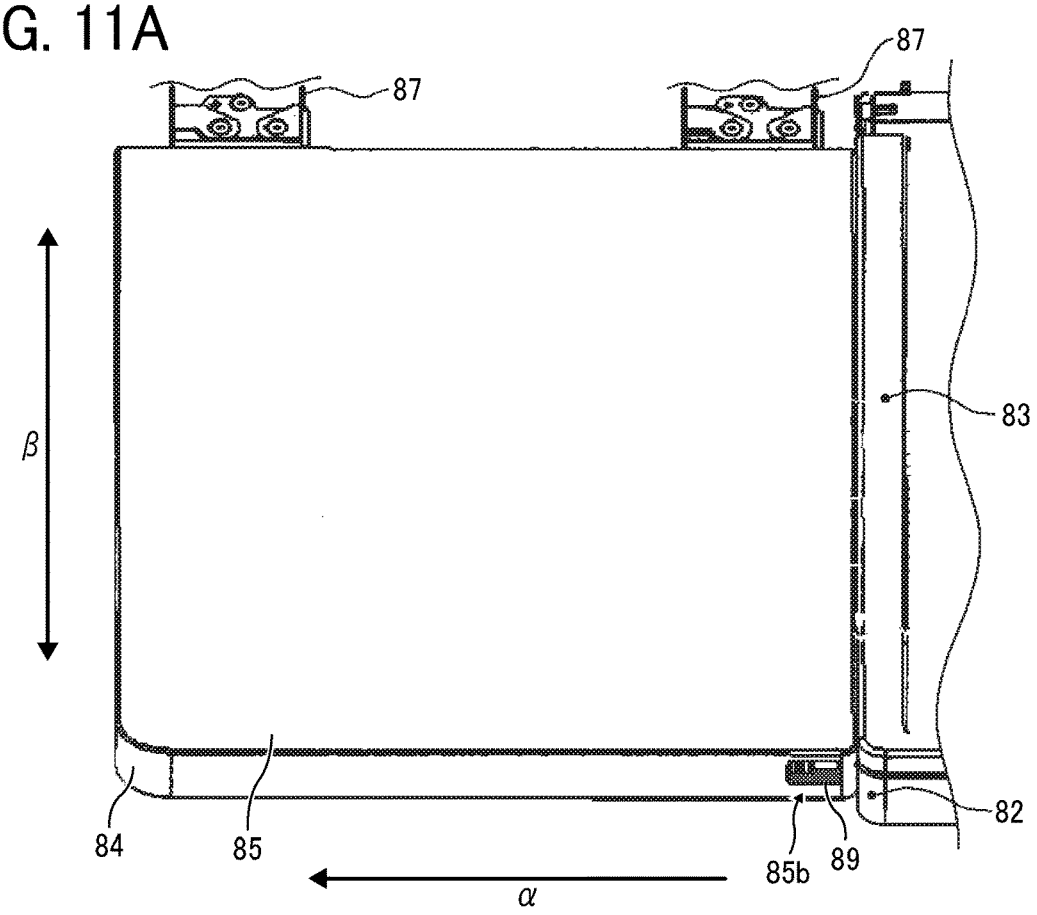
FIGS. 11A and 11B are schematic views illustrating a second coupling portion between the extension tray and the extension-tray cover and the apparatus body.
Figure 11B:
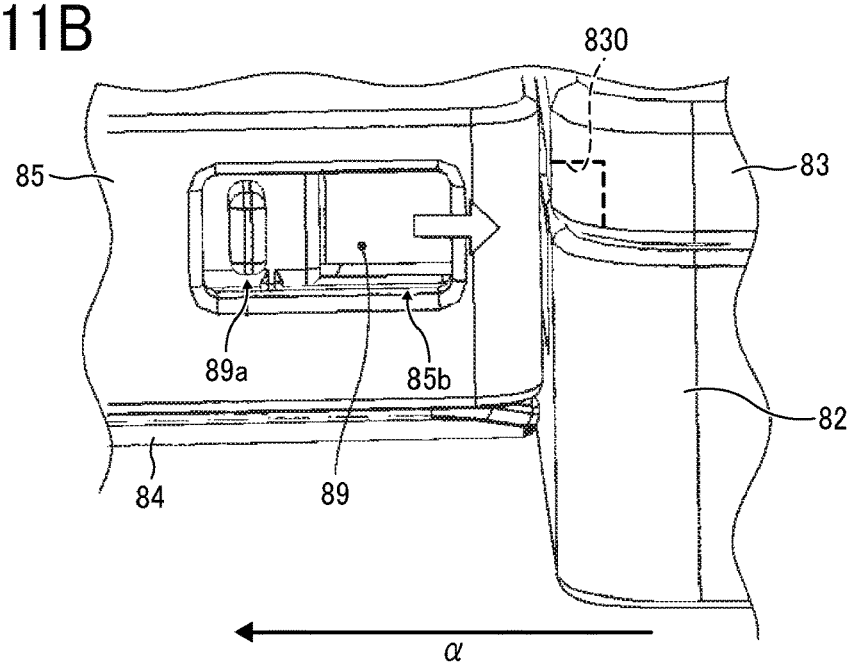

FIGS. 11A and 11B are schematic views illustrating a second coupling portion of the extension tray 84 and the extension-tray cover 85 with the apparatus body 1.

At the end of the extension-tray cover 85 opposite the coupling parts 86 (engaging the coupling parts 87) in the sheet width direction β, a positioning insertion 89 (i.e., an opposite-side coupling portion) is disposed. The positioning insertion 89 is removably inserted into an insertion hole 830 or recess in either the reversing tray 82 or the reversing-tray cover 83 attached to the apparatus body 1. The positioning insertion 89 of the extension-tray cover 85 is inserted in the insertion hole 830 formed in a face (the downstream end face of the reversing tray 82 or the reversing-tray cover 83 in the sheet conveyance direction α) perpendicular to the face (on which the coupling part 87 is disposed) of the apparatus body 1 parallel to the sheet conveyance direction α. Alternatively, the positioning insertion 89 can be disposed at the opposite end of the extension tray 84. The positioning insertion 89 on the extension-tray cover 85 is movable (e.g., to approach and move away) relative to the insertion hole 830 formed in the reversing-tray cover 83 back and forth in the sheet conveyance direction α. The positioning insertion 89 includes a grip 89*a* to be gripped by the user. The extension-tray cover 85 further includes a window 85*b*, through which the user slides the positioning insertion 89. Through the window 85*b*, the user grips the grip 89*a* and slides the positioning insertion 89 toward or away from the insertion hole 830. The positioning insertion 89 inserted in the insertion hole 830 contacts at least an upper inner wall of the insertion hole 830, and the position thereof is determined. Thus, the position of the extension-tray cover 85 relative to the reversing tray 82 or the reversing-tray cover 83 is determined.

Variation 1

Variation 1 of the image forming apparatus adopting one or more aspects of the present disclosure is described below.

Figure 12:
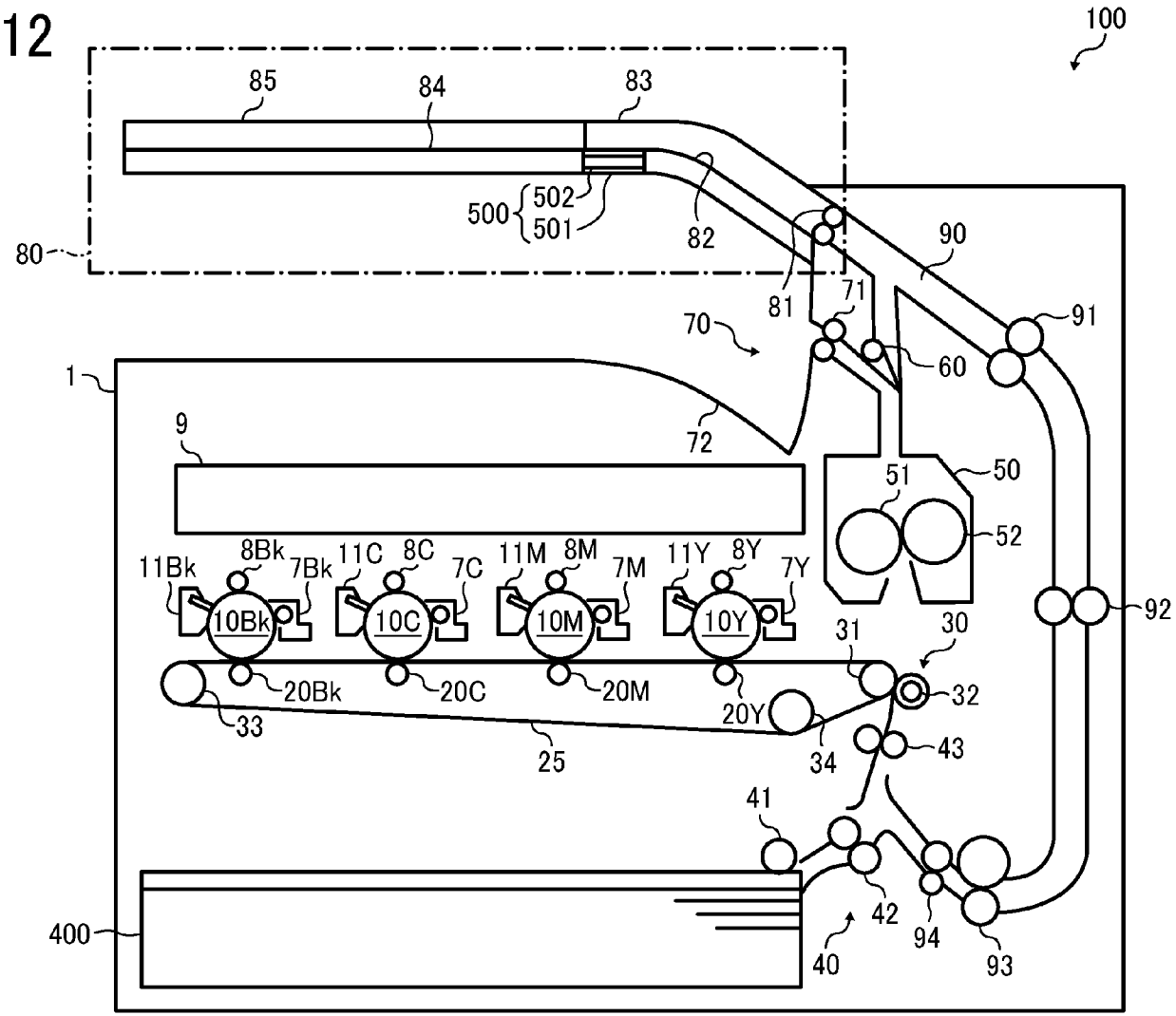
FIG. 12 is a schematic diagram illustrates a printer according to Variation 1.

FIG. 12 is a schematic diagram illustrates the printer 100 according to Variation 1.

In Variation 1, similar to the printer 100 according to the above-described embodiment and illustrated in FIG. 1, the printer 100 includes the sheet outlet provided with the ejection roller pair 71 and the reverse outlet located above the sheet outlet and provided with the reversing roller pair 81. The printer 100 further includes the reversing tray 82 to guide the bottom face of the reversed sheet P2 and the reversing-tray cover 83 to cover the reversing tray 82.

The printer 100 of Variation 1 is similar to the printer illustrated in FIG. 1 except that an ancillary tray 500 is built in the reversing tray 82. Therefore, redundant descriptions concerning the structure similar to that of the above-described embodiment will be omitted, focusing on the differences.

The ancillary tray 500 includes a base portion 501 and an end portion 502. The ancillary tray 500 is extendable from and retractable into the reversing tray 82 in the sheet conveyance direction α. The length of the ancillary tray 500 is shorter than the extension tray 84.

Figure 13:
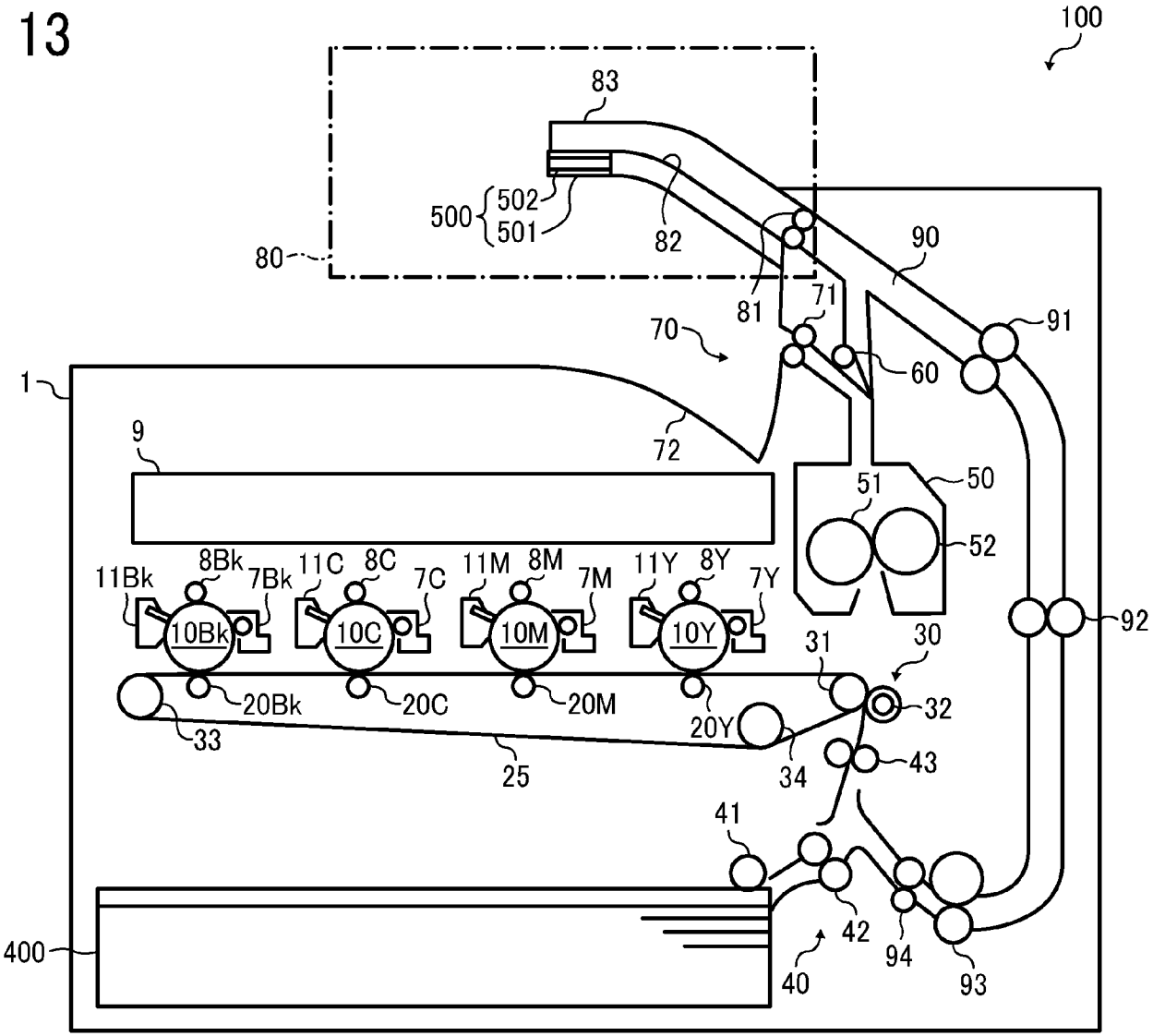
FIG. 13 is a schematic view of the printer of Variation 1, being in a state in which the extension tray and the extension-tray cover are removed.
Figure 14:
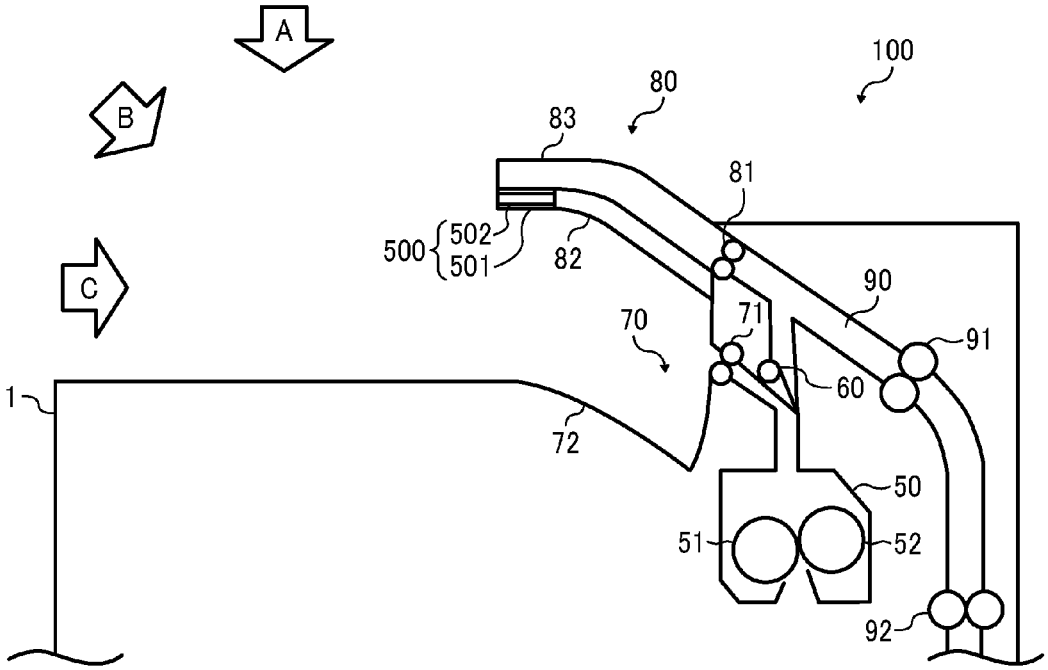
FIG. 14 is a cross-sectional view of the sheet reversing section and the adjacent portion of the printer in the state illustrated in FIG. 13.
Figure 15:
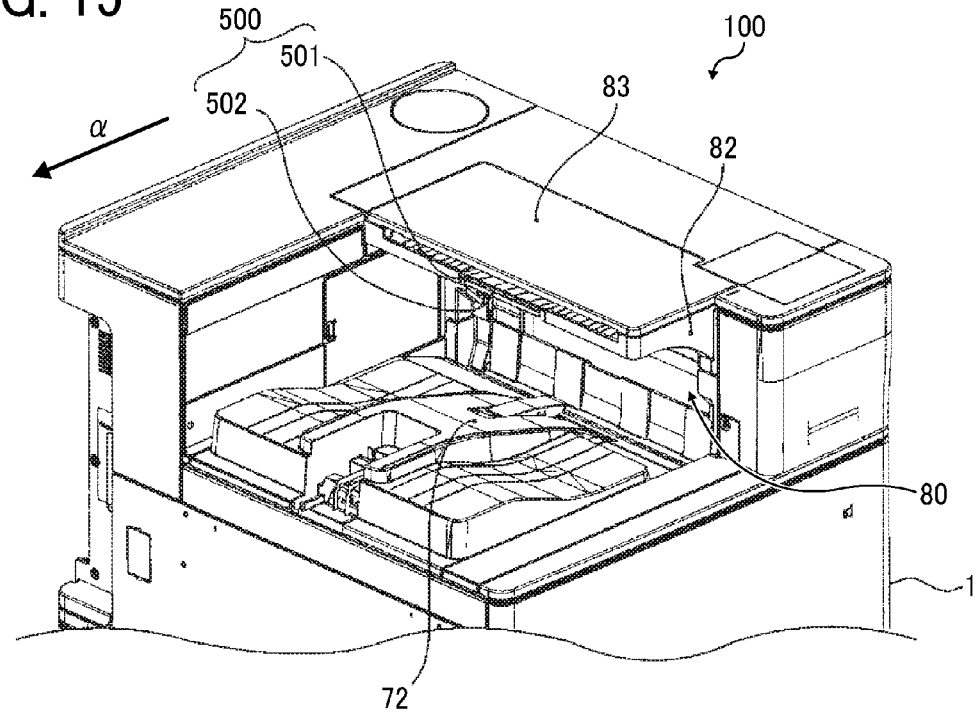
FIG. 15 is a perspective view of the sheet reversing section and the adjacent portion of the printer in the state illustrated in FIG. 13.

FIG. 13 is a schematic view of the printer 100 in a state which the extension tray 84 and the extension-tray cover 85 are removed from the state illustrated in FIG. 12. FIG. 14 is a cross-sectional view of the sheet reversing section 80 and the adjacent portion of the printer 100 in the state illustrated in FIG. 13. FIG. 15 is a perspective view of the sheet reversing section 80 and the adjacent portion of the printer 100 in the state illustrated in FIG. 13.

Figure 16:
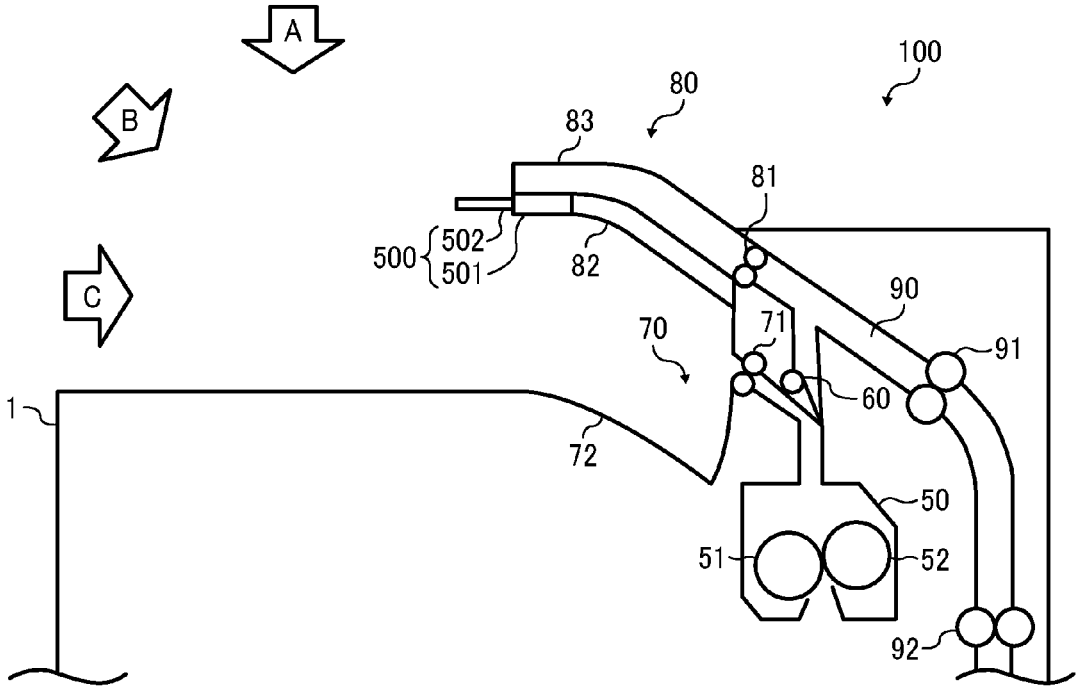
FIG. 16 is a cross-sectional view of the sheet reversing section and the adjacent portion of the printer of Variation 1, being in a state in which an end portion of the ancillary tray is pulled out from the reversing tray.
Figure 17:
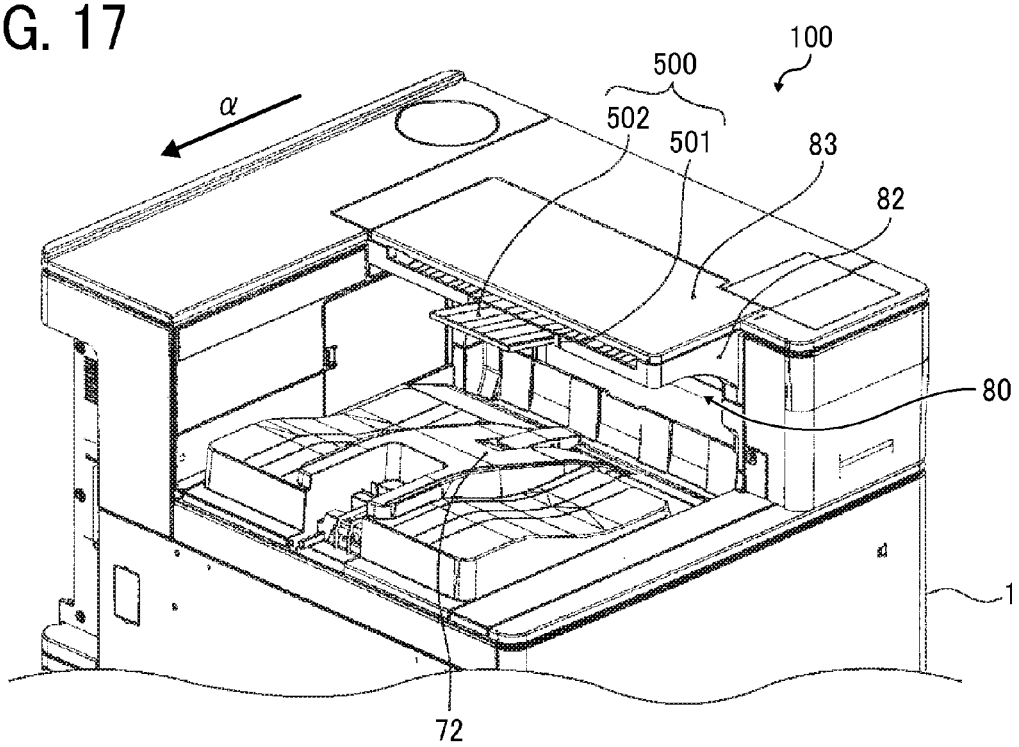
FIG. 17 is a perspective view of the sheet reversing section and the adjacent portion of the printer in the state illustrated in FIG. 16.
Figure 18:
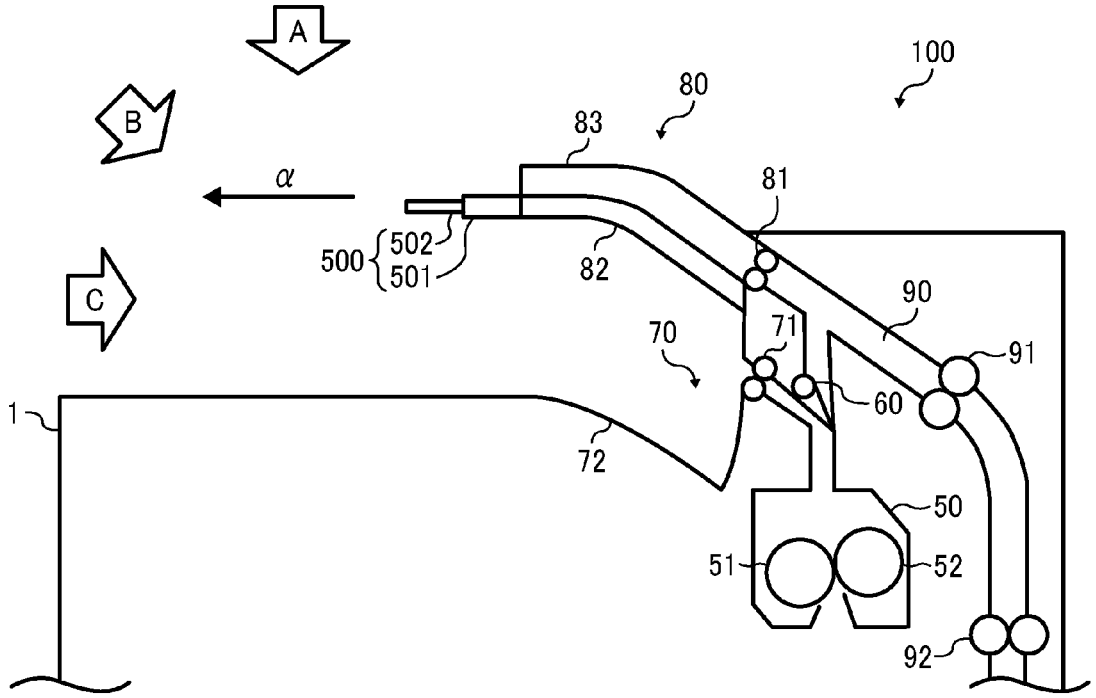
FIG. 18 is a cross-sectional view of the sheet reversing section and the adjacent portion of the printer of Variation 1, being in a state in which the end portion and an ancillary-tray base of the ancillary tray is pulled out from the reversing tray.
Figure 19:
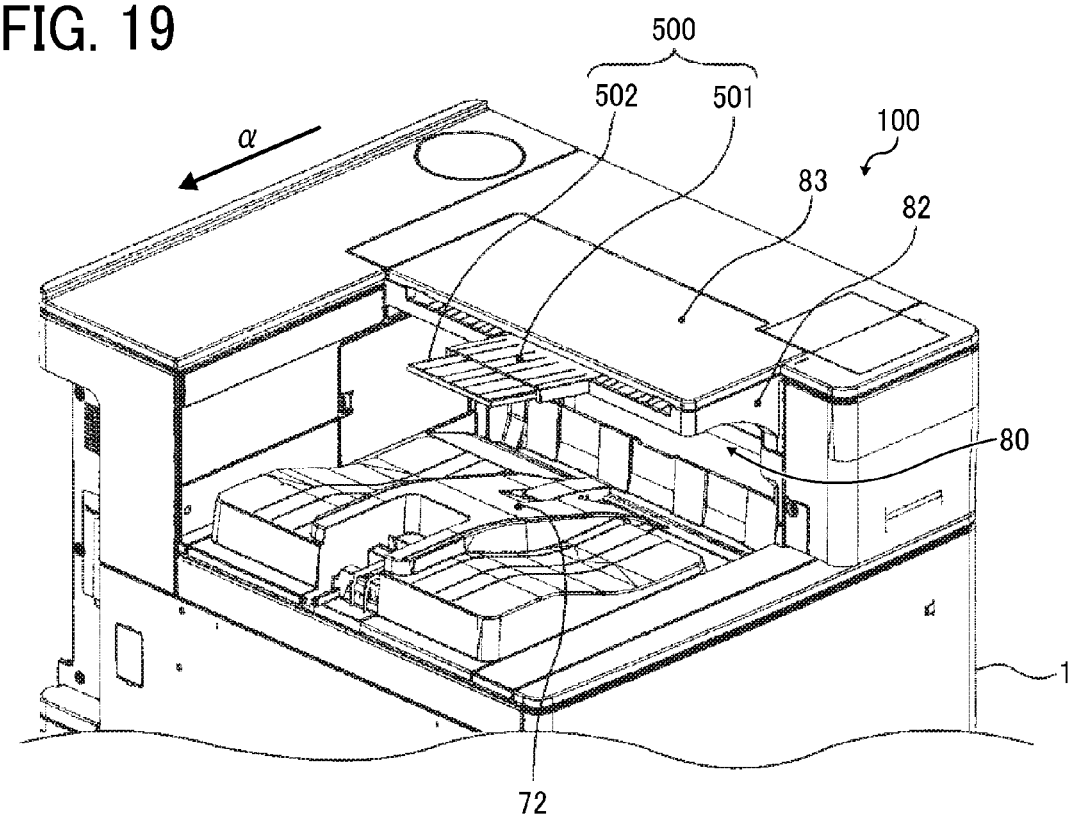
FIG. 19 is a perspective view of the sheet reversing section and the adjacent portion of the printer in the state illustrated in FIG. 18.

FIG. 16 is a cross-sectional view of the sheet reversing section 80 and the adjacent portion of the printer 100 in a state in which the end portion 502 of the ancillary tray 500 is pulled out from the reversing tray 82. FIG. 17 is a perspective view of the sheet reversing section 80 and the adjacent portion of the printer 100 in the state illustrated in FIG. 16. FIG. 18 is a cross-sectional view of the sheet reversing section 80 and the adjacent portion of the printer 100 in a state in which the end portion 502 and the base portion 501 of the ancillary tray 500 are pulled out from the reversing tray 82. FIG. 19 is a perspective view of the sheet reversing section 80 and the adjacent portion of the printer 100 in the state illustrated in FIG. 18.

At least one of the end portion 502 and the base portion 501 can have a ragged upper face e.g., with a projection or a recess) to oppose the sheet P. An example of the ragged shape is formed by multiple ribs (similar to 865 illustrated in FIGS. 9 through 10B), each of which extends in the sheet conveyance direction α. The multiple ribs (disposed on the upper face of at least one of the end portion 502 and the base portion 501) are arranged side by side in the sheet width direction β perpendicular to the sheet conveyance direction α. This structure can reduce the area of contact of the ancillary tray 500 with the sheet P, compared with a case where such ribs are not provided. Then, the resistance against sheet conveyance can be reduced to improve sheet conveyance.

In the printer 100 of Variation 1 as well, the reversing tray 82 guides the bottom face of the sheet P reversed by the reversing roller pair 81. The reversing-tray cover 83 is disposed above the reversing tray 82, and the reversing tray 82 and the reversing-tray cover 83 are secured or fixed to the apparatus body 1.

In Variation 1, when single-side image formation is executed in the printer 100 from which the extension tray 84 and the extension-tray cover 85 are removed, the ejection roller pair 71 discharges the sheet P transported to the sheet ejection section 70 onto the output tray 72, similar to the above-described embodiment. The sheets P are sequentially stacked on the output tray 72. By contrast, to perform double side image formation, before image formation, the ancillary tray 500 is pulled out from the reversing tray 82 to the downstream side in the sheet conveyance direction α from the state illustrated in FIG. 13. Then, during image formation, the switching claw 60 illustrated in FIG. 1 switches the route of sheet conveyance to transport the sheet P bearing an image on one side to the sheet reversing section 80 including the reversing tray 82, the reversing-tray cover 83, and the ancillary tray 500. The sheet P bearing images on both sides thereof is transported to the sheet ejection section 70.

Specifically, in the sheet reversing section 80, while clamping the trailing end of the sheet P, the reversing roller pair 81 temporarily discharges the sheet P onto the reversing tray 82 and the ancillary tray 500. Subsequently, the reversing roller pair 81 is rotated in reverse with the motor, to feed the sheet P to the re-feed passage 90. Then, the sheet P is fed via the conveyance roller pairs 91, 92, 93, and 94 and the registration roller pair 43 to the transfer section, and an image is secondarily transferred from the intermediate transfer belt 25 onto the back side of the sheet P.

As illustrated in FIGS. 14 and 19, the retractable ancillary tray 500 can be extended by a given length. To perform double-side image formation, before starting image formation, the ancillary tray 500 is pulled out from the reversing tray 82 by a necessary length.

Figure 20:
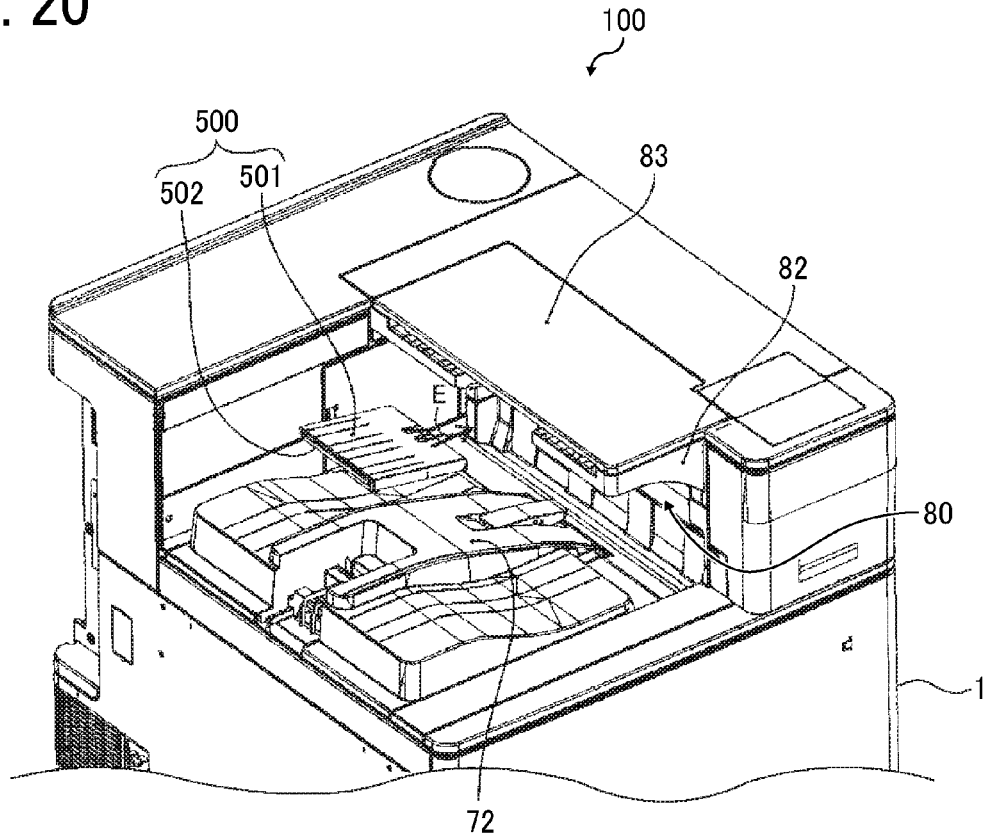
FIG. 20 is a perspective view of the sheet reversing section and the adjacent portion of the printer of Variation 1, being in a state in which the ancillary tray is not attached to the reversing tray.

FIG. 20 is a perspective view of the sheet reversing section 80 and the adjacent portion of the printer 100 of Variation 1 in a state before the ancillary tray 500 is attached to the reversing tray 82. In the state in which the end portion 502 is attached to the base portion 501 as illustrated in FIG. 20, the ancillary tray 500 is inserted into the reversing tray 82 in the direction indicated by arrow E in FIG. 20. Then, the ancillary tray 500 is contained in the reversing tray 82 as illustrated in FIG. 15. In the state illustrated in FIG. 15, the ancillary tray 500 is attached, by snap-fit, to the reversing tray 82 not to be disengaged therefrom. Although the ancillary tray 500 being pulled out in normal operation is not disengaged from the reversing tray 82, the ancillary tray 500 is configured to be removed from the reversing tray 82 for maintenance work or the like.

As illustrated in FIGS. 14 and 15, in the state in which the ancillary tray 500 is fully retracted, the ancillary tray 500 is entirely contained inside the reversing tray 82. Accordingly, in the state illustrated in FIGS. 14 and 15, the discharged sheets P1 on the output tray 72 are visible and taken out from any of directions indicated by arrows A, B, and C.

Figure 21:
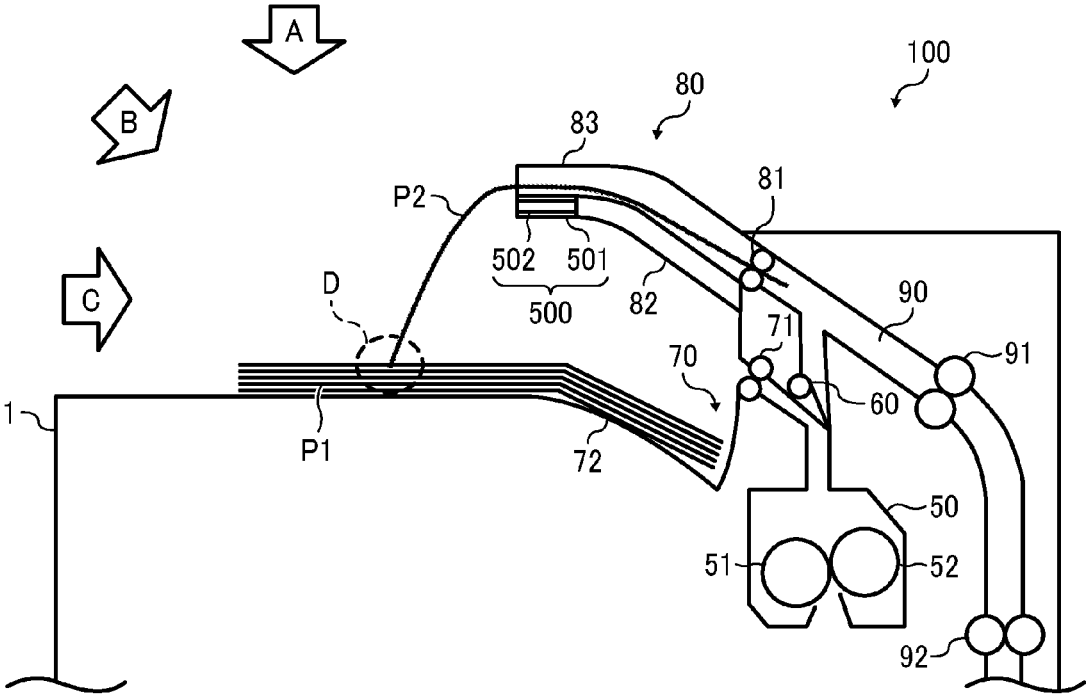
FIG. 21 is a cross-sectional view of the sheet reversing section and the adjacent portion according to Variation 1, being in a state in which a long sheet is fed to the sheet reversing section with the ancillary tray fully retracted.

FIG. 21 is a cross-sectional view of the sheet reversing section 80 and the adjacent portion of the printer 100 in a state in which the reversed sheet P2 that is long such as an A3-size is fed to the sheet reversing section 80 with the ancillary tray 500 fully retracted.

As illustrated in FIG. 21, in the case of the long reversed sheet P2, the reversed sheet P2 is longer than the length supportable by the reversing tray 82, and the leading side of the reversed sheet P2 is undesirably draped from the reversing tray 82. Accordingly, the leading side of the reversed sheet P2 may contact the sheets P1 discharged on the output tray 72 as indicated by broken circle D in FIG. 21. In such a case, the sheet P2 being reversed may disturb alignment of the sheets P1 or push the sheets P1 out from the output tray 72.

Figure 22:
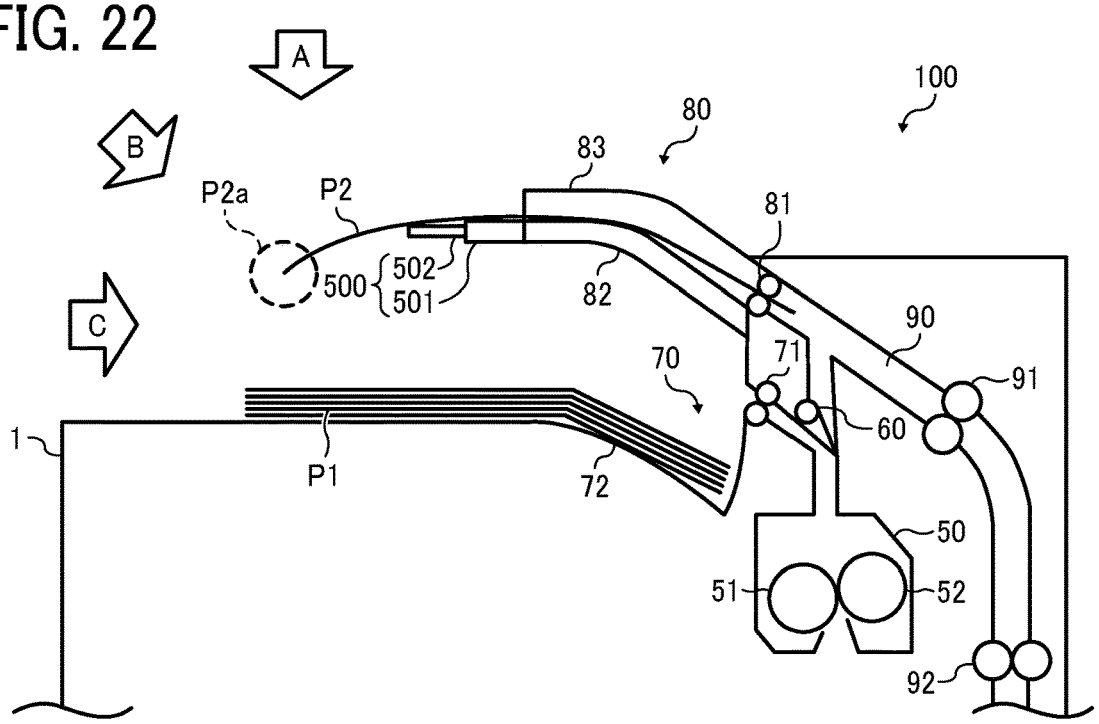
FIG. 22 is a cross-sectional view of the sheet reversing section and the adjacent portion according to Variation 1, being in a state in which the long sheet is fed to the sheet reversing section with the ancillary tray fully extended.

FIG. 22 is a cross-sectional view of the sheet reversing section 80 and the adjacent portion of the printer 100 in the state in which the long sheet P2 such as an A3-size sheet is fed to the sheet reversing section 80 with the ancillary tray 500 fully extended.

In the state illustrated in FIGS. 18 and 19, the ancillary tray 500 is pulled out by a greater amount compared with the state illustrated in FIGS. 14 and 15. However, the width and the length of the ancillary tray 500 are set to bare minimum such that a leading end P2*a* (in FIG. 22) of the sheet P2 does not contact the discharged sheets P1 even in feeding of long sheets such as A3-size sheets. Accordingly, visibility and removal of the sheets P1 discharged on the output tray 72 are not degraded.

In FIGS. 16 and 17, the length by which the ancillary tray 500 is pulled out is intermediate between the state illustrated in FIGS. 14 and 15 and the state illustrated in FIGS. 18 and 19. When the sheet P is longer than A4 size bus is shorter than A3 size, the ancillary tray 500 can be set to the state illustrated in FIGS. 16 and 17 to prevent the contact between the reversed sheet P2 and the discharged sheets P1 while maintaining the visibility and ease of removal of the discharged sheets P1.

The description of Variation 1 above concerns the ancillary tray 500 that includes two components, the base portion 501 and the end portion 502, and configured to be extended and retracted stepwise. The number of components of the ancillary tray 500 is not limited two but can be one or greater than two.

The ancillary tray 500 according to Variation 1 is movable to a first position contained in the reversing tray 82 as illustrated in FIGS. 14 and 15 and a second position pulled out from the reversing tray 82 as illustrated in FIGS, 18 and 19. The ancillary tray 500 being at the second position guides the bottom face of the reversed sheet P2.

Additionally, in Variation 1, when the ancillary tray 500 is at the first position, the extension tray 84 serving as the second sheet guide is attachable to and removable from the apparatus body 1.

The ancillary tray 500 according to Variation 1 is a two-component tray. When only the end portion 502 is pulled out from the reversing tray 82 as illustrated in FIGS. 16 and 17, the ancillary tray 500 is extended to the intermediate position (illustrated in FIGS. 16 and 17) between the first position and the second position. The ancillary tray 500 according to Variation 1 is not limited to the configuration to be pulled out in two steps as long as the ancillary tray 500 is movable to the first position contained in the reversing tray 82 and at least one position pulled out from the reversing tray 82. In another variation, two or more ancillary trays 500 can be provided.

Figure 23:
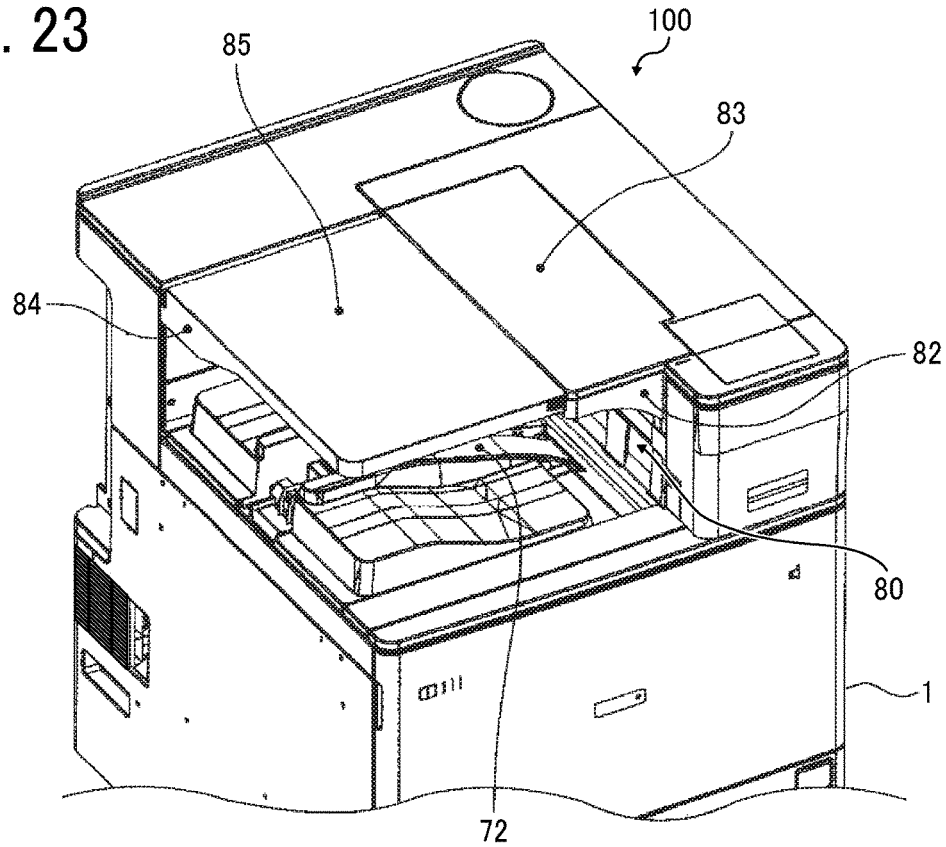
FIG. 23 is a perspective view of the sheet reversing section and the adjacent portion of the printer in the state illustrated in FIG. 12.
Figure 24:
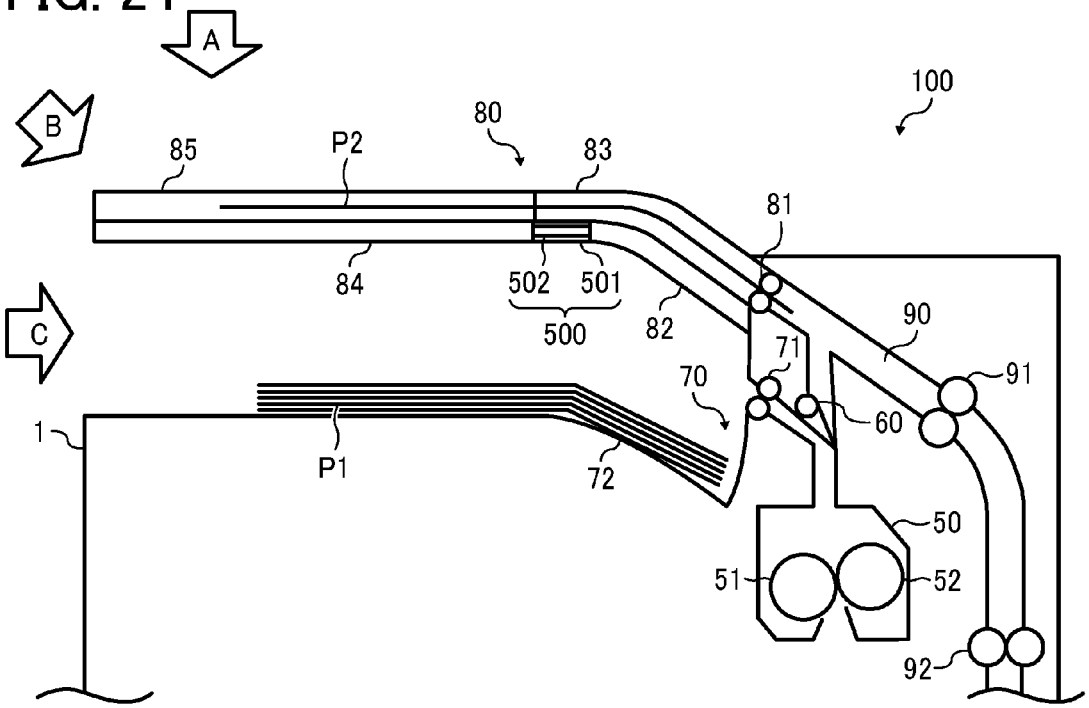
FIG. 24 is a cross-sectional view of the sheet reversing section and the adjacent portion according to Variation 1, being in the state in which the extension tray and the extension-tray cover are attached to the sheet reversing section and the sheet is fed thereto.

Next, descriptions are given below of the state (similar to that illustrated in FIG. 12) in which the extension tray 84 and the extension-tray cover 85 are attached to the printer 100 of Variation 1. FIG. 23 is a perspective view of the sheet reversing section 80 and the adjacent portion of the printer 100 in the state illustrated in FIG. 12. FIG. 24 is a cross-sectional view of the sheet reversing section 80 and the adjacent portion of the printer 100 in the state in which the extension tray 84 and the extension-tray cover 85 are attached to the sheet reversing section 80 (as illustrated in FIGS. 12 and 23) and the reversed sheet P2 is fed thereto.

The ancillary tray 500 of the printer 100 according to Variation 1 is extendable and retractable. Further, as illustrated in FIGS. 14 and 15, when fully retracted, the ancillary tray 500 is entirely contained in the reversing tray 82 not to project therefrom. Accordingly, in Variation 1, the extension tray 84 and the extension-tray cover 85 (similar to those of the embodiment illustrated in FIGS. 1 through 11A) can be attached to the apparatus body 1 when the ancillary tray 500 is contained inside the reversing tray 82.

In FIGS. 21 and 22, the leading side of the reversed sheet P2 is clearly exposed, to the user, from the reversing tray 82 and the reversing-tray cover 83. Accordingly, the user may pull out the sheet P2 being reversed in the sheet reversing section 80. If the user pulls out the sheet P2 being reversed in the sheet reversing section 80, the printer 100 can determine that defective sheet conveyance, such as paper jam, has occurred in the route of sheet conveyance and cause paper jam unexpected for the printer 100. In the case of high-speed image forming apparatus capable of image formation on a large number of sheets per unit time, the speed of sheet conveyance in reverse is also high. Therefore, the user may feel uncomfortable seeing the sheet P2 bursting out at high speed from the reversing tray 82 or the reversing-tray cover 83.

In view of the foregoing, in Variation 1, the ancillary tray 500 is contained inside the reversing tray 82 as illustrated in FIGS. 13 through 15, and the extension tray 84 and the extension-tray cover 85 are attached to the apparatus body 1 as illustrated in FIGS. 12, 23, and 24. Accordingly, the sheet P2 being reversed in the sheet reversing section 80 is hidden from the user, and there is no chance for the user to pull out the sheet P2 being reversed in the sheet reversing section 80. Thus, paper jam caused thereby is inhibited. Since the leading side of the sheet P2 is not exposed from the sheet reversing section 80, the user is inhibited from seeing the sheet P2 bursting out at high speed and feeling uncomfortable.

In the embodiment described above with reference to FIGS. 1 through 11B, the extension tray 84 and the extension-tray cover 85 are attached to the printer 100 when the long sheet P such as an A3-size sheet is fed to the sheet reversing section 80. When the extension tray 84 and the extension-tray cover 85 attached to the apparatus body 1 cover the output tray 72 from above, ease of removal of the discharged sheets P1 on the output tray 72 is degraded.

In the embodiment described with reference to FIGS. 1 through 11B, attachment and removal of the extension tray 84 and the extension-tray cover 85 are required to switch the printer 100 between the configuration for feeding of long sheets to the sheet reversing section 80 and the configuration for feeding of sheets that are not long. Such attachment and removal impose unnecessary work and unnecessary time on users who want only to prevent the reversed sheet P2 from disturbing the alignment of the discharged sheets P1 and pushing out the discharged sheets P1 from the output tray 72.

By contrast, in Variation 1, in feeding of long sheets to the sheet reversing section 80, the user can select one of pulling out of the ancillary tray 500 and attaching of the extension tray 84 and the extension-tray cover 85. When the ancillary tray 500 is pulled out, even when the long sheet such as an A3-size sheet is fed, the ancillary tray 500 guides, at least partly, the bottom face of the reversed sheet P2. The extended ancillary tray 500 can prevent the reversed sheet P2 from contacting the discharged sheets P1, thereby preventing the reversed sheet P2 from disturbing alignment of the discharged sheets P1 and pushing the sheets P1 out the output tray 72.

Additionally, in Variation 1, the length and the area of the ancillary tray 500 to guide the bottom face of the reversed sheet P2 are bare minimum to prevent the reversed sheet P2 from contacting the discharged sheets P1 on the output tray 72.

Figure 25:
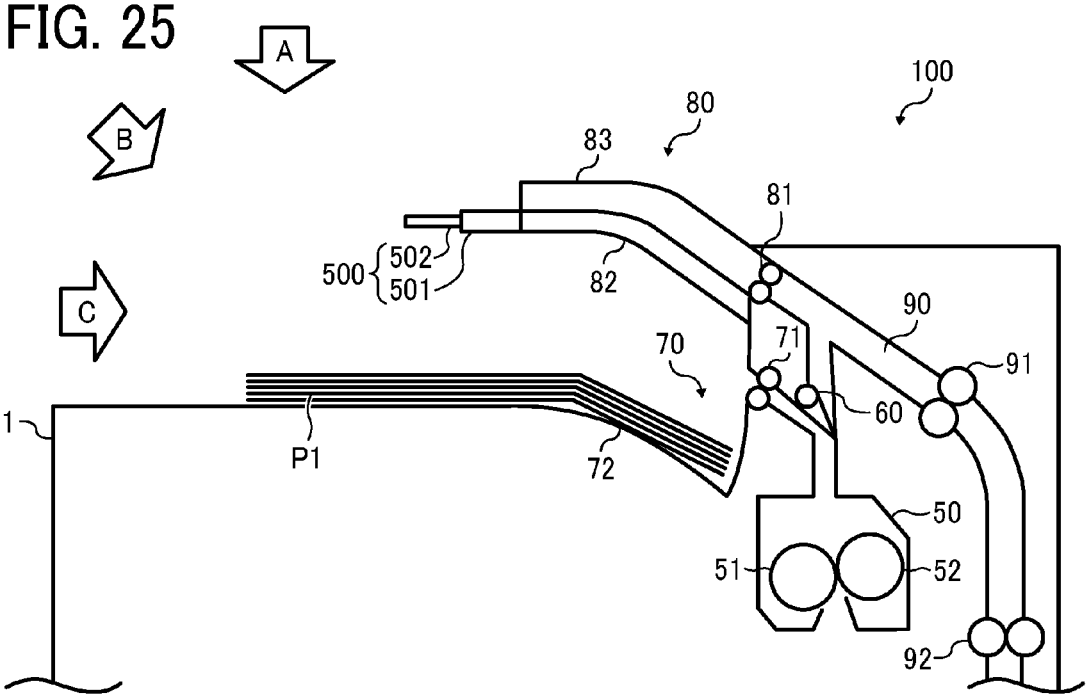
FIG. 25 is a cross-sectional view of the sheet reversing section and the adjacent portion according to Variation 1, in the state in which the ancillary tray is fully extended and image formation is completed.
Figure 26:
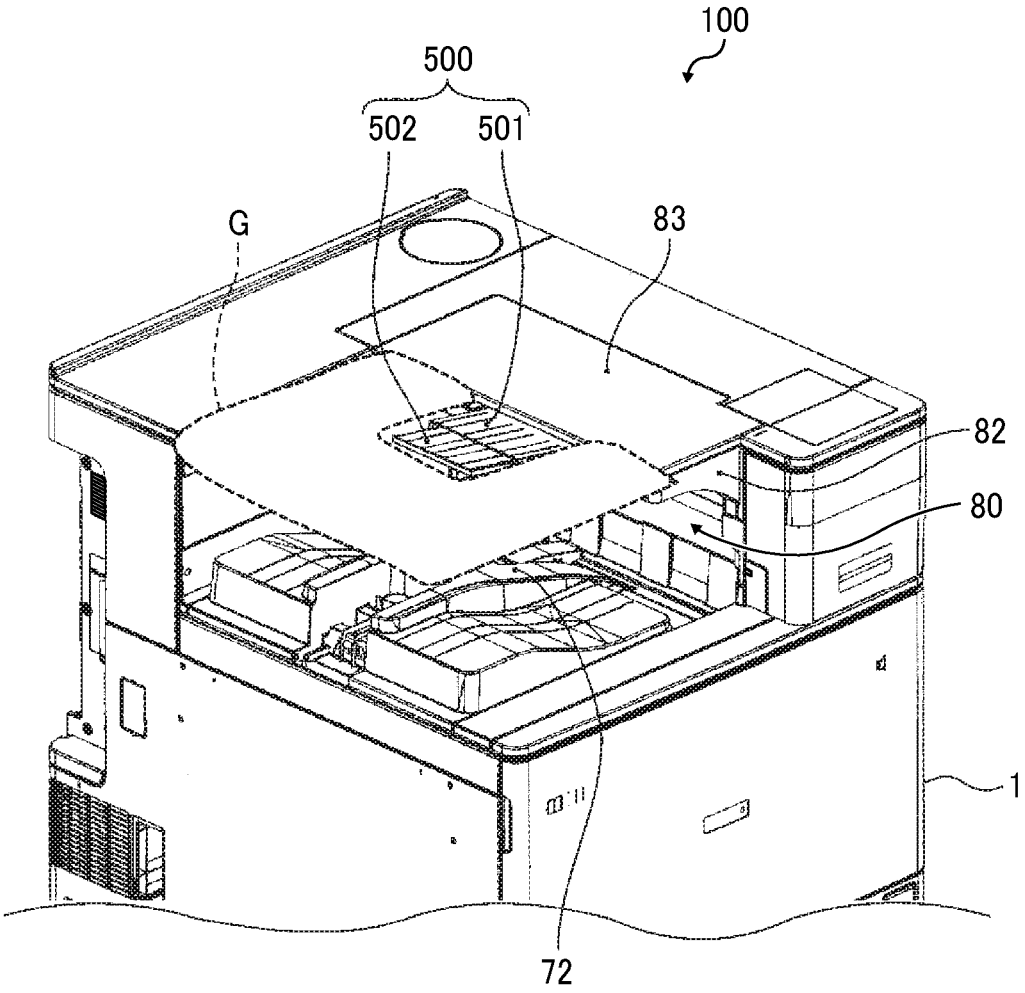
FIG. 26 is a perspective view illustrating the printer according Variation 1, in which the ancillary tray is filly extended, together with a range to be covered with the extension tray and the extension-tray cover.

FIG. 25 is a cross-sectional view of the sheet reversing section 80 and the adjacent portion of the printer 100 in the state in which the ancillary tray 500 is fully extended and image formation is completed. FIG. 26 is a perspective view illustrating the printer 100 in which the ancillary tray 500 is fully extended. In FIG. 26, a range G is to be covered with the extension tray 84 and the extension-tray cover 85 is added.

As illustrated in FIG. 26, even in the state in which the ancillary tray 500 is fully extended, the range of the output tray 72 covered with the ancillary tray 500 is smaller than the range G to be covered with the extension tray 84 and the extension-tray cover 85 when these are attached to the printer 100.

Accordingly, even in the state in which the ancillary tray 500 is fully extended, the discharged sheets P1 on the output tray 72 are visible and taken out from any of directions indicated by arrows A, B, and C.

The visibility and ease of removal of the discharged sheets P1 in the state illustrated in FIG. 25, in which the ancillary tray 500 is fully extended, are not significantly different from the state illustrated in FIGS. 14 and 15, in which the ancillary tray 500 is contained inside the reversing tray 82.

In the printer 100 of Variation 1, use of the ancillary tray 500 secures the visibility and ease of removal of the discharged sheets P1 on the output tray 72 even in the state in which the ancillary tray 500 guides the bottom face of a long sheet such as A3 size.

Additionally, the printer 100 of Variation 1 includes the built-in ancillary tray 500 that is extendable from and retractable into the reversing tray 82 that accommodates a middle sheet size up to A4 size, for example. In the case where the ancillary tray 500 is not necessary, for example, single-side image formation or double-side image formation on sheet sizes up to A4 size, the reversing tray 82 is used, with the ancillary tray 500 contained therein. When a long sheet such as an A3-size sheet is reversed, the ancillary tray 500 is pulled out to prevent the reversed sheet P2 from contacting a bundle of discharged sheets P1 on the output tray 72. In this configuration, alignment of the discharged sheets P1 is not disturbed, and the sheets P1 are not pushed out the output tray 72.

When long sheets such as A3-size sheets are not fed, the ancillary tray 500 can be promptly contained inside the reversing tray 82. Thus, the sheet reversing section 80 of the printer 100 can be easily switched between the configuration for feeding of sheet sizes up to A4 size and the configuration for feeding of long sheet size such as A3 size.

When exposure of the reversed sheet P2 to users does not cause inconveniences, the amount by which the ancillary tray 500 is pulled out can be adjusted easily and quickly to use the printer 100 of Variation 1, without attaching the extension tray 84 and the extension-tray cover 85 thereto. Even in the state in which the ancillary tray 500 is fully extended, the discharged sheets P1 on the output tray 72 are well visible and taken out easily.

By contrast, when exposure of the reversed sheet P2 to users cause inconveniences, the ancillary tray 500 is kept inside the reversing tray 82, and the extension tray 84 and the extension-tray cover 85 are attached to the printer 100. In this configuration, alignment of the discharged sheets P1 is not disturbed, and the sheets P1 are not pushed out the output tray 72. Further, the user is inhibited from pulling out the reversed sheet P2. Since the leading side of the sheet P2 is not exposed from the sheet reversing section 80, the user is inhibited from seeing the sheet P2 bursting out at high speed and feeling uncomfortable.

The printer 100 of Variation 1 uses, in combination, the extension tray 84 and the extension-tray cover 85 having a length to hide sheets entirely in the sheet conveyance direction from the user and the ancillary tray 500 that is extendable and retractable. This structure enables the user to freely select one of use of the extension tray 84 and the extension-tray cover 85 and use of the extendable and retractable ancillary tray 500 in feeding of long sheets P to the sheet reversing section 80.

Variation 2

Descriptions are given below of Variation 2 of the image forming apparatus adopting one or more aspects of the present disclosure.

Figure 27:
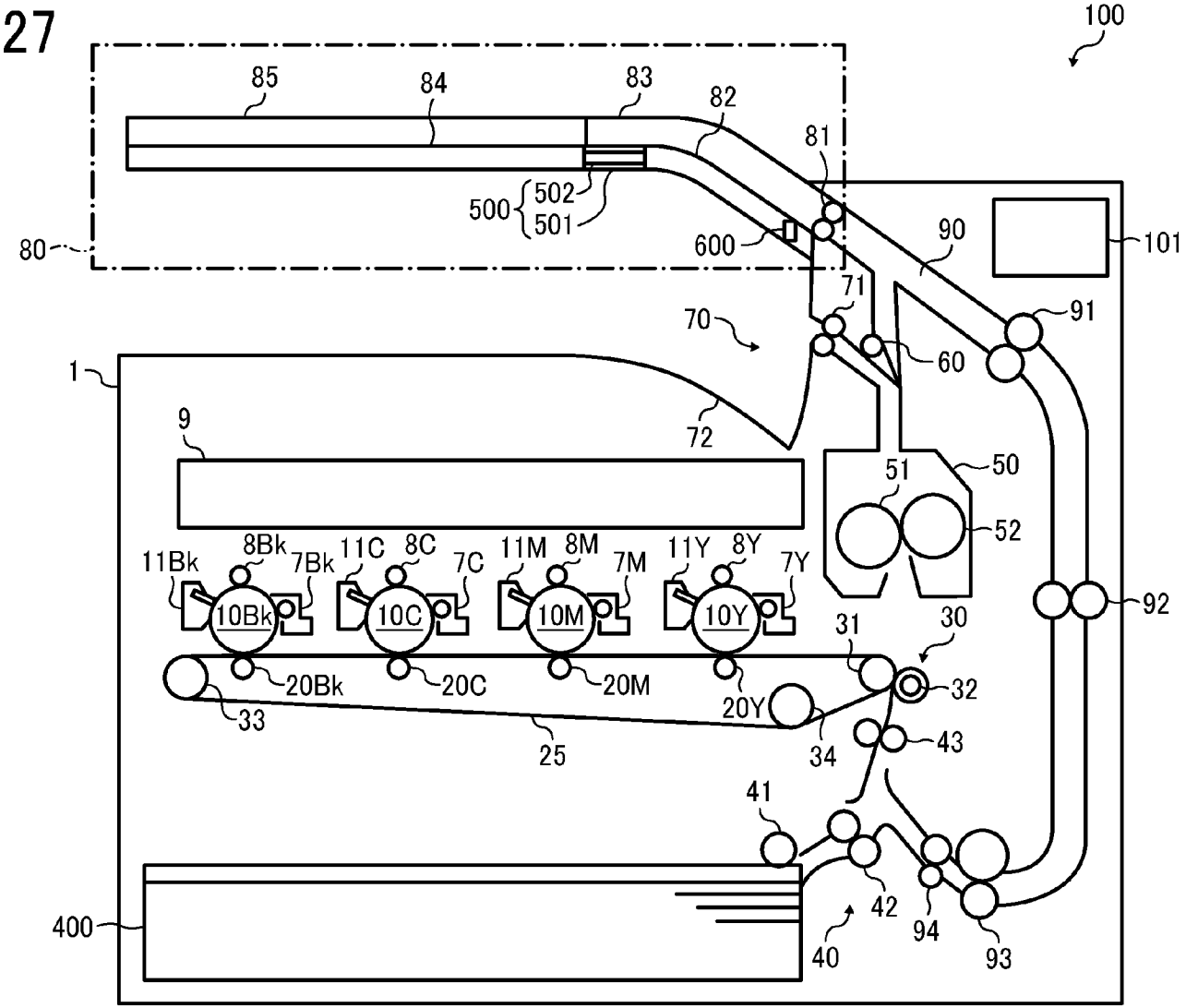
FIG. 27 is a schematic diagram illustrates a printer according to Variation 2.

FIG. 27 is a schematic view of the printer 100 according to Variation 2.

The printer 100 of Variation 2 is similar to the printer illustrated in FIG. 1 except that the reversing-tray cover 83 is openable and closable relative to the reversing tray 82 and a cover open/close sensor 600 detects whether the reversing-tray cover 83 is open or dosed. Therefore, redundant descriptions concerning the structure similar to that of the above-described embodiment or Variation 1 will be omitted, focusing on the differences.

Figure 28:
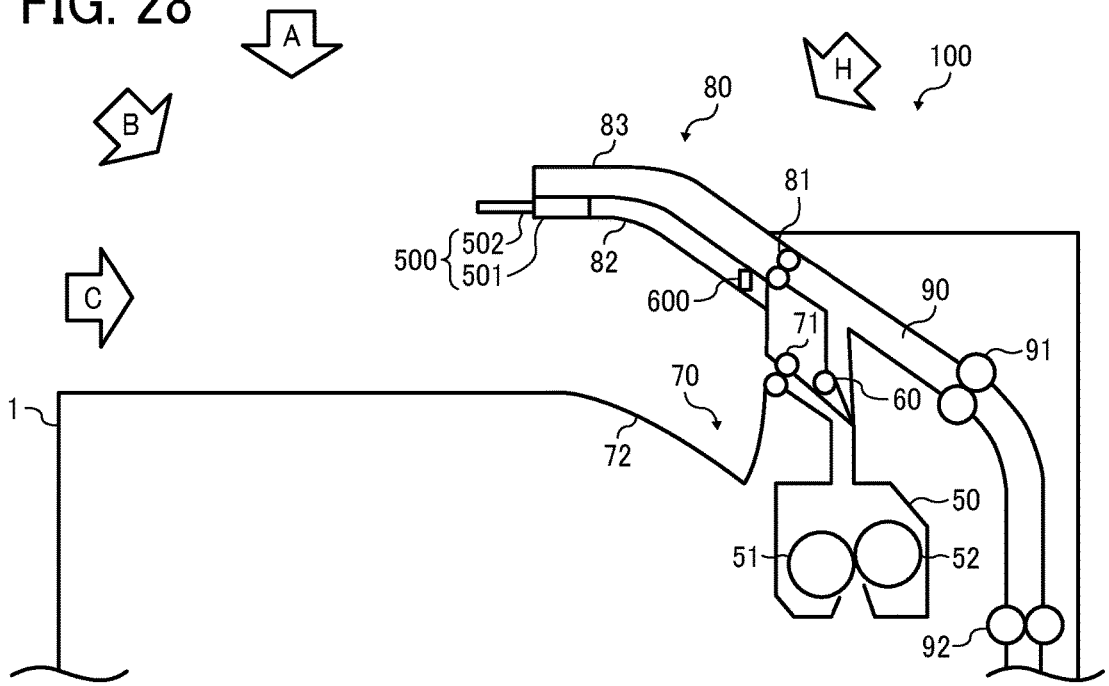
FIG. 28 is a cross-sectional view of the sheet reversing section and the adjacent portion according to Variation 2, in a state in which the extension tray and the extension-tray cover are removed and the end portion of the ancillary tray is pulled out from the reversing tray.
Figure 29:
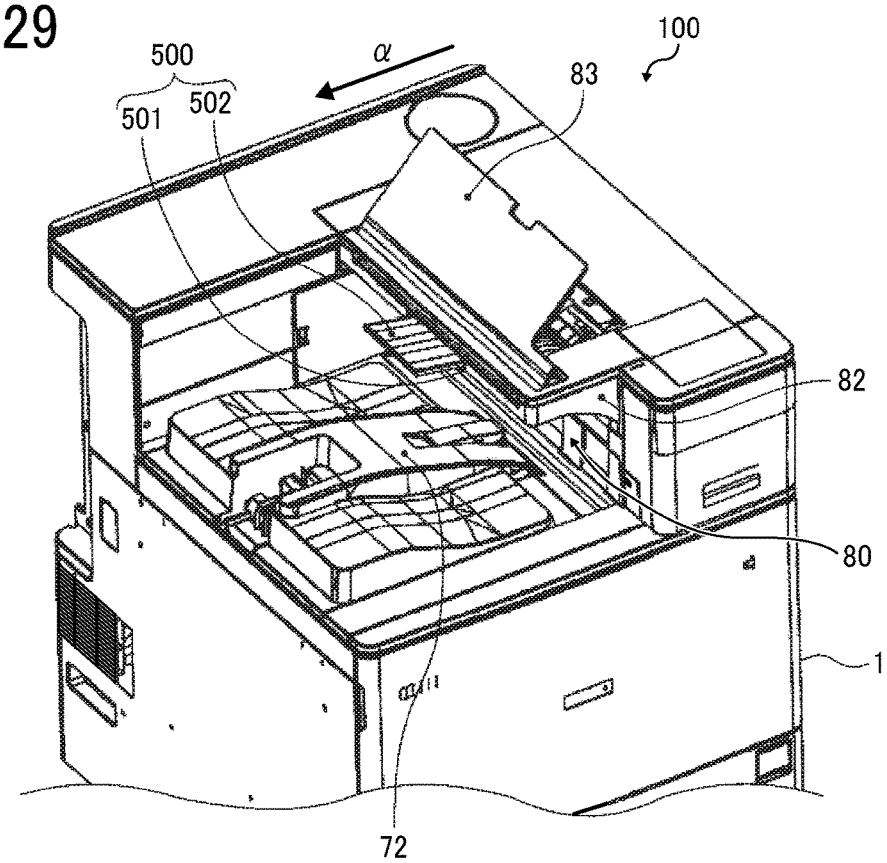
FIG. 29 is a perspective view of the sheet reversing section and the adjacent portion of the printer in the state in which the reversing-tray cover is opened from the state illustrated in FIG. 28.

FIG. 28 is a cross-sectional view of the sheet reversing section 80 and the adjacent portion of the printer 100 from which the extension tray 84 and the extension-tray cover 85 are removed, in a state in which only the end portion 502 of the ancillary tray 500 is pulled out from the reversing tray 82, FIG. 29 is a perspective view of the sheet reversing section 80 and the adjacent portion of the printer 100 in the state in which the reversing-tray cover 83 is opened from the state illustrated in FIG. 28.

Figure 30:
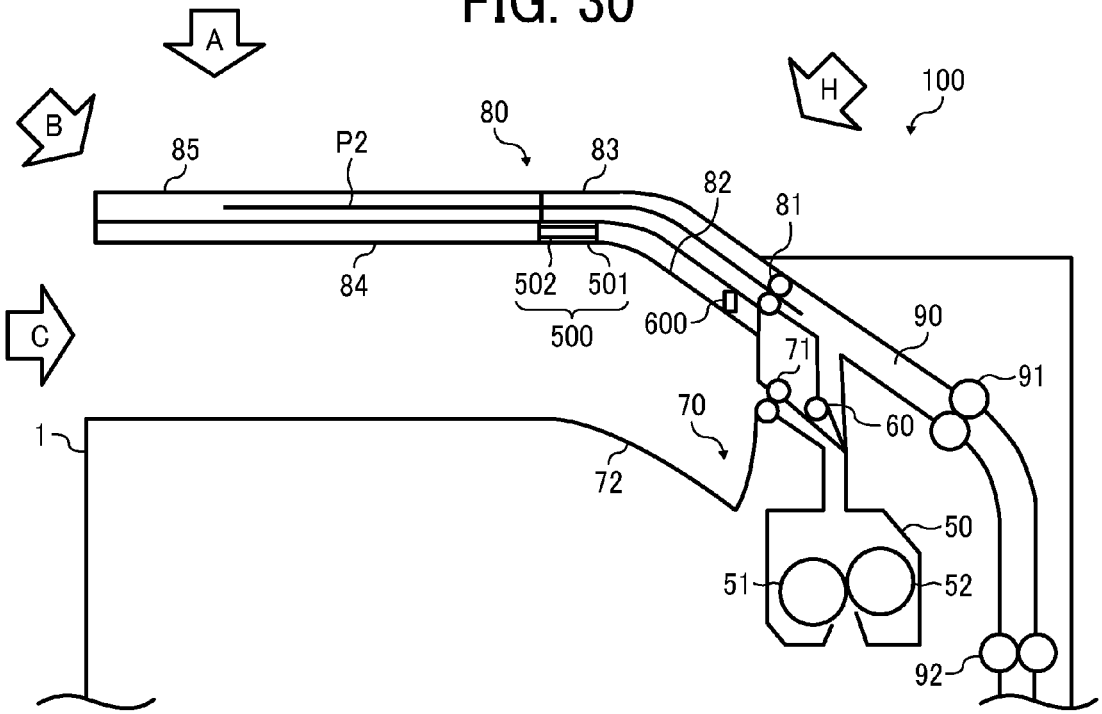
FIG. 30 is a cross-sectional view illustrating the sheet reversing section and the adjacent portion in a state in which the extension tray and the extension-tray cover are attached thereto.
Figure 31:
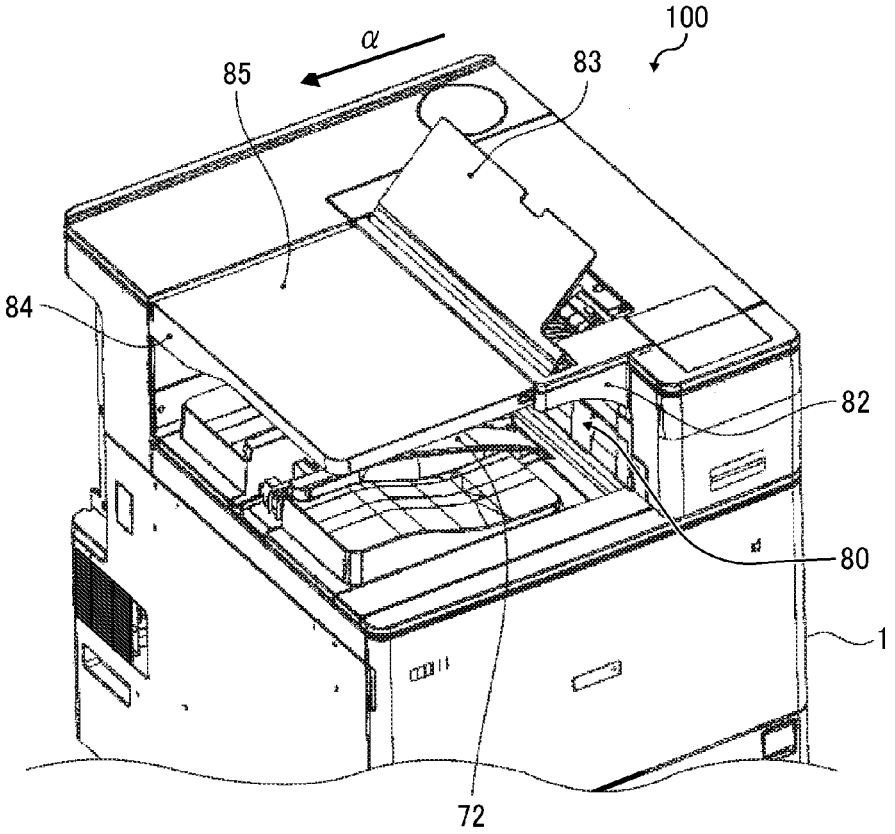
FIG. 31 is a perspective view of the sheet reversing section and the adjacent portion of the printer in the state in which the reversing-tray cover is opened from the state illustrated in FIG. 30.

FIG. 30 is a cross-sectional view illustrating the sheet reversing section 80 and the adjacent portion in a state in which the extension tray 84 and the extension-tray cover 85 are attached thereto, FIG. 31 is a perspective view of the sheet reversing section 80 and the adjacent portion of the printer 100 in the state in which the reversing-tray cover 83 is opened from the state illustrated in FIG. 30.

As illustrated in FIGS. 29 and 31, the reversing-tray cover 83 is hinged to pivot around a rotation shaft disposed adjacent to the downstream end of the reversing tray 82 in the sheet conveyance direction α. The reversing-tray cover 83 is rotatable relative to the reversing tray 82. Further, as illustrated in FIGS. 28 and 30, the cover open/close sensor 600 is disposed in a portion of the reversing tray 82 to be exposed when the reversing-tray cover 83 is opened. The cover open/close sensor 600 may be an optical sensor or an interlock switch.

Next, descriptions are given below of an operation to remove jammed sheets from the sheet reversing section 80 of the printer 100 according to Variation 2.

In the printer 100 of Variation 2, the reversing-tray cover 83 can be opened or closed regardless of whether the ancillary tray 500 is extended or retracted. In FIGS. 28 and 29, only the end portion 502 is pulled out from the reversing tray 82. In Variation 2, the reversing-tray cover 83 is openable and closable in the state in which the ancillary tray 500 is contained in the reversing tray 82, and even in the state in which the ancillary tray 500 is fully extended, which are respectively similar to the states of Variation 1 illustrated in FIGS. 14 and 18. In the case of paper jam in the sheet reversing section 80, when the reversing-tray cover 83 is open as illustrated in FIG. 29, the user or operator can access the jammed sheet in the direction indicated by arrow H in FIG. 28 and easily remove the jammed sheet.

In the printer 100 of Variation 2, the reversing-tray cover 83 can be opened or closed as well when the extension tray 84 and the extension-tray cover 85 are attached to the sheet reversing section 80 as illustrated in FIGS. 30 and 31. In the case of paper jam in the sheet reversing section 80, in the state in which the reversing-tray cover 83 is open as illustrated in FIG. 31, the user can access the jammed sheet in the direction indicated by arrow H in FIG. 30 and easily remove the jammed sheet.

Figure 32:
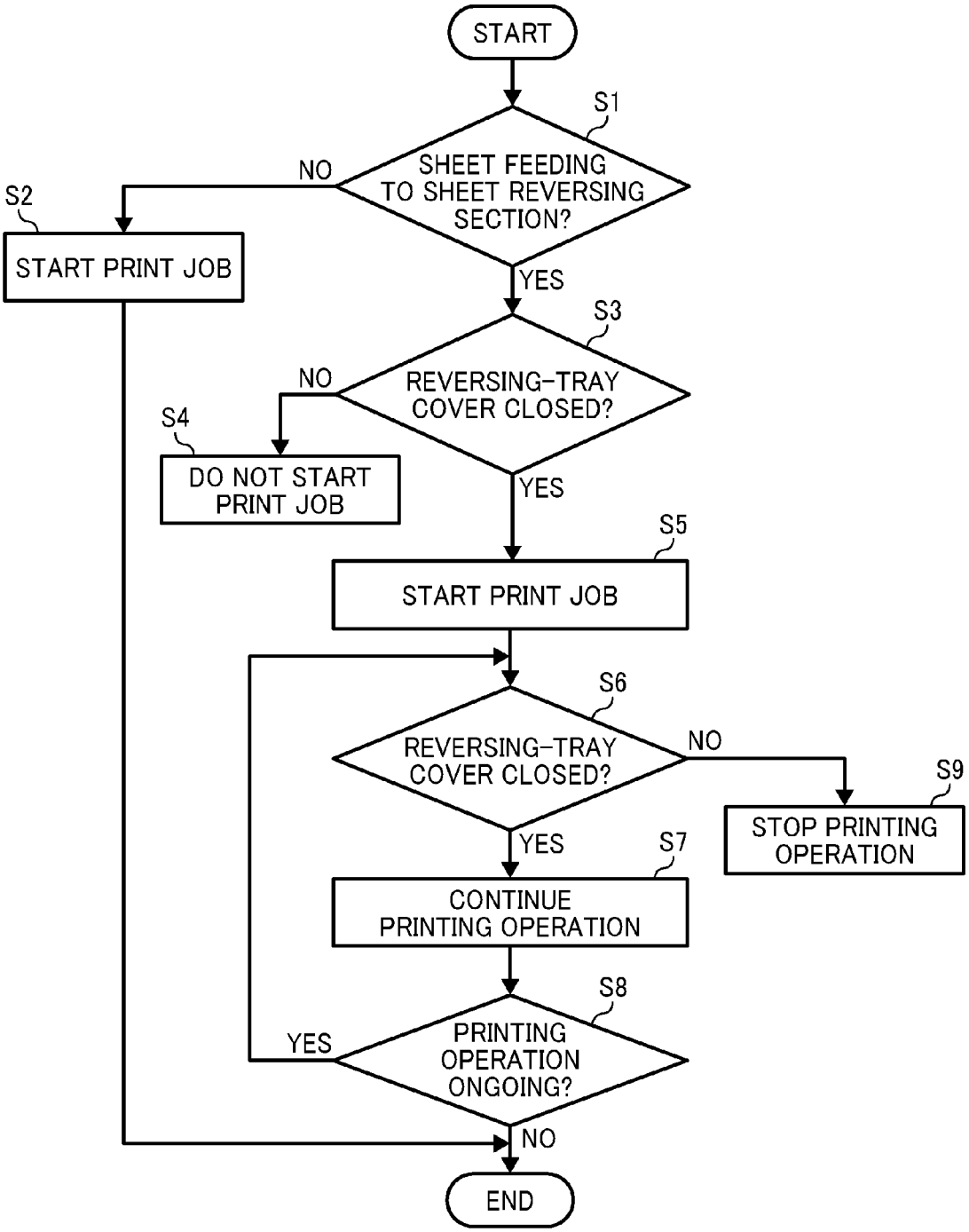
FIG. 32 is a flowchart of control operation of the printer according to Variation 2, based on detection results generated by a cover open/close sensor.

Next, descriptions are given below of a proactive operation to prevent paper jam in the sheet reversing section 80 of the printer 100 according to Variation 2 and avoidance of unnecessary printing stop, FIG. 32 is a flowchart of control operation of the printer 100 of Variation 2 based on detection results generated by the cover open/close sensor 600.

The printer 100 of Variation 2 includes the cover open/close sensor 600 disposed in the portion opened and closed by the reversing-tray cover 83 to detect whether the reversing-tray cover 83 is open or closed (i.e., open/close state). Printing operation is executed according to the flow illustrated in FIG. 32 depending on the open/close state of the reversing-tray cover 83 to prevent paper jam and avoid unnecessary printing stop.

The flow illustrated in FIG. 32 starts upon a printing start instruction. When a print job is input and printing start is instructed to the printer 100, as S1, the controller 101 determines whether or not the print job (or the operation mode) involves feeding of the sheet P to the sheet reversing section 80. In an operation such as single-side printing in which the sheet P does not pass through the sheet reversing section 80 (No at S1), at S2, the print job is started without detection of the open/close state of the reversing-tray cover 83. That is, in the operation in which the sheet P does not pass through the sheet reversing section 80, sheet feeding (e.g., for a print job) is started regardless of the open/close state of the reversing-tray cover 83.

After the print job is started, the open/close state of the reversing-tray cover 83 is not detected with the cover open/close sensor 600. In other words, in the operation in which the sheet P does not pass through the sheet reversing section 80, sheet feeding is not stopped even when the reversing-tray cover 83 is opened midway in feeding of the sheet P. With this configuration, unnecessary stop is avoided in the operation, such as single-side printing, that does not relate to the sheet reversing section 80.

By contrast, when the controller 101 determines that the print job involves, for example, double-side printing and the sheet P is fed to the sheet reversing section 80 (Yes at S1), at S3, the detection by the cover open/close sensor 600 is executed. Specifically, at S3, the controller 101 determines whether or not the reversing-tray cover 83 is closed. When the detection result generated by the cover open/close sensor 600 indicates that the reversing-tray cover 83 is open (No at S3), at S4 the controller 101 does not start the print job. This control operation can prevent the occurrence of paper jam caused by sheet feeding with the reversing-tray cover 83 kept open.

When the controller 101 determines that the reversing-tray cover 83 is closed (Yes at S3) based on the detection result generated by the cover open/close sensor 600, the print job is started at S5. In the case of operation in which the sheet P passes through the sheet reversing section 80, after the print job is started, detection of the open/close state of the reversing-tray cover 83 with the cover open/close sensor 600 is continued until the print job is completed in steps 6 through 8. Specifically, when the controller 101 determines that the reversing-tray cover 83 is closed (Yes at S6), at S7, the controller 101 continues printing operation. When a predetermined time period elapses, at S8, the controller 101 determines whether or not the printing operation is ongoing. If the reversing-tray cover 83 is opened during the printing operation, there is a risk that the sheet P gets caught in the sheet reversing section 80, resulting in paper jam. Accordingly, at S9, the printing operation is stopped in response to the determination that the reversing-tray cover 83 is open based on the detection by the cover open/close sensor 600 (No at S6), which continues from the start of the printing operation until the completion of the printing operation. In other words, in the case where the reversing-tray cover 83 is opened midway through the operation in which the sheet passes through the sheet reversing section 80, the printing operation is stopped, thereby stopping the feeding of the sheet to the sheet reversing section 80. This operation can prevent the occurrence of paper jam caused by opening of the reversing-tray cover 83 during the printing operation.

In the configuration including the reversing-tray cover 83 to cover the reversing tray 82 as in the embodiment illustrated in FIGS. 1 through 11A and the Variation 1, removal of jammed sheets from the sheet reversing section 80 is not easy when the sheet conveyance passage is covered with the reversing-tray cover 83. By contrast, when the reversing-tray cover 83 is openable and closable relative to the reversing tray 82 as described in Variation 2, removal of jammed sheets is facilitated.

In the structure in which the reversing-tray cover 83 is openable and closable, there is a risk that the sheet P is get stuck and jammed when the sheet P passes through the sheet reversing section 80 for, for example, double-side printing, with the reversing-tray cover 83 kept open. By contrast, in Variation 2, the sheet reversing section 80 includes the cover open/close sensor 600. In Variation 2, in the printing operation in which the sheet P passes through the sheet reversing section 80, the printing operation is stopped when the cover open/close sensor 600 detects the reversing-tray cover 83 being open. This control operation can prevent the occurrence of paper jam caused by sheet feeding with the reversing-tray cover 83 kept open.

In Variation 2, in addition to the configuration of Variation 1, the reversing-tray cover 83 is openable and closable and the cover open/close sensor 600 to detect the open/close state of the reversing-tray cover 83 is provided. The feature that the reversing-tray cover 83 is openable and closable and the feature that the cover open/close sensor 600 is provided can adapt to a configuration, such as the printer 100 of the embodiment described with reference to FIGS. 1 through 11B, that does not include the ancillary tray 500.

The structures described above are just examples, and the various aspects of the present specification attain respective effects as follows.

Aspect A

Aspect A concerns a sheet stacker that includes a sheet stack table, such as the output tray 72, on which a sheet is stacked, and a sheet reversing section, such as the sheet reversing section 80, disposed above the sheet stack table and defining a sheet reverse passage to reverse the direction of conveyance of the sheet fed thereto. The sheet reversing section includes a first sheet guide such as the reversing tray 82 to guide a bottom face of the sheet and a second sheet guide such as the extension tray 84 to guide the bottom face of the sheet downstream from the first sheet guide in a sheet conveyance direction in which the sheet is fed to the sheet reversing section. The second sheet guide is attachable to and removable from an apparatus body (e.g., the apparatus body 1 of the printer 100 or the body of the sheet stacker).

In Aspect A, for feeding of a sheet longer than the first sheet guide in the sheet conveyance direction, the second sheet guide is attached to the apparatus body, and the bottom face of the long sheet fed to the sheet reversing section is guided by the first sheet guide and the second sheet guide. This configuration can prevent the leading side of the sheet from draping from the sheet reversing section and contacting the sheet stacked on the sheet stack table. Accordingly, the sheet in the sheet reversing section is inhibited from disturbing the alignment of the sheet placed on the sheet stack table and pushing the sheet out from the sheet stack table. Further, for feeding of a sheet having a length equal to or shorter than the first sheet guide in the sheet conveyance direction, the second sheet guide is removed from the apparatus body. This configuration can improve the visibility and ease of removal of the sheet on the sheet stack table corresponding the decrease in the area of the sheet stack table covered with the second sheet guide, compared with the state in which the second sheet guide is attached to the apparatus body.

Aspect B

In Aspect A, the sheet reversing section includes a first guide cover, such as the reversing-tray cover 83, to cover the first sheet guide and a second guide cover, such as the extension-tray cover 85, to cover the second sheet guide removably attachable to the apparatus body. As described above, this configuration can inhibit the user from pulling out the sheet being reversed. Further, the user is inhibited from seeing the sheet bursting out and feeling uncomfortable.

Aspect C

In Aspect A or B, a sheet-opposing face to oppose the sheet) of at least one of the first sheet guide, the second sheet guide, the first guide cover, and the second guide cover has a ragged shape formed with a projection and a recess. As described above, this structure facilitates sheet conveyance.

Aspect D

In Aspect C, the sheet-opposing face includes a plurality of ribs, such as the ribs 865, each extending in the sheet conveyance direction, and the plurality of ribs are arranged in a sheet width direction perpendicular to the sheet conveyance direction to form the ragged shape. As described above, this structure facilitates sheet conveyance.

Aspect E

In any one of Aspects A through D, one of the second sheet guide and the second guide cover includes a coupling portion, such as the coupling part 86, to be coupled with a coupled portion, such as the coupling part 87, of the apparatus body, and one of the coupling portion and the coupled portion has an insertion hole (e.g., the insertion recess 87*a*) and the other of the coupling portion and the coupled portion has a hooked shape (e.g., the hook portion 86*a*). With this structure, as described above, the second sheet guide and the second guide cover can be easily attached to and removed from the apparatus body without using a tool.

Aspect F

In Aspect E, one of the second sheet guide and the second guide cover further includes an opposite-side coupling portion, such as the positioning insertion 89, disposed opposite the coupling portion in a sheet width direction, and the opposite-side coupling portion is to engage an opposite-side coupled portion (e.g., the insertion hole 830) of the apparatus body. Alternatively, the opposite-side coupled portion is disposed in either the first sheet guide or the first guide cover as described with reference to FIGS. 11A and 11B. As described above, this structure can reduce misalignment of the second sheet guide relative to the apparatus body (or the first sheet guide) and inhibit defective sheet conveyance.

Aspect G

In Aspect F, the opposite-side coupled portion of the apparatus body has an insertion hole (e.g., the insertion hole 830), and the opposite-side coupling portion such as the positioning insertion 89 is to move into and away from the opposite-side coupled portion. With this structure, as described above, the opposite-side coupling portion can be coupled with and disengaged from the opposite-side coupled portion easily without using a tool.

Aspect H

In Aspect G, the opposite-side coupling portion is to fit in the opposite-side coupled portion to determine a position of the opposite-side coupling portion relative to the first sheet guide or the apparatus body. With this structure, as described above, positioning of the second sheet guide relative to the first sheet guide or the apparatus body can be made easily without using a tool such as a screw.

Aspect I

In any one of Aspects A through H, the sheet reversing section further includes an ancillary guide, such as the ancillary tray 500, configured to move between a first position contained inside the first sheet guide (e.g. the reversing tray 82) and a second position downstream in the sheet conveyance direction from a downstream end of the first sheet guide, and the ancillary guide guides the bottom face of the sheet at the second position.

According to Aspect I, for feeding of a sheet longer than the first sheet guide in the sheet conveyance direction, the ancillary guide is moved to the second position, and the first sheet guide and the ancillary guide together guide the bottom face of the long sheet fed to the sheet reversing section. This configuration can prevent the leading side of the sheet from draping from the sheet reversing section and contacting the sheet stacked on the sheet stack table such as the output tray 72. Accordingly, the sheet in the sheet reversing section is inhibited from disturbing the alignment of the sheet placed on the sheet stack table and pushing the sheet out from the sheet stack table. Further, for feeding of a sheet having a length equal to or shorter than the first sheet guide in the sheet conveyance direction, the ancillary guide is contained inside the first sheet guide. This configuration can improve the visibility and ease of removal of the sheet on the sheet stack table corresponding the decrease in the area of the sheet stack table covered with the ancillary guide, compared with a state in which the ancillary guide is at the second position.

Aspect J

In Aspect I, the second sheet guide such as the extension tray 84 is attachable to and removable from the apparatus body when the ancillary guide such as the ancillary tray 500 is at the first position. With this configuration, as described in Variation 1, when a sheet longer in the sheet conveyance direction than the first sheet guide is used, the user can select one of attaching the second sheet guide and moving the ancillary guide to the second position.

Aspect K

In Aspect I or J, a sheet-opposing face of the ancillary guide such as the ancillary tray 500 to oppose the sheet has a ragged shape, which is formed by ribs, for example. As described above in Variation 1, this aspect facilitates sheet conveyance.

Aspect L

In any one of Aspects A through K, the sheet reversing section includes a guide cover such as the reversing-tray cover 83 to cover the first sheet guide (e.g., the reversing tray 82) and configured to open and close relative to the first sheet guide. The sheet reversing section further includes a guide cover sensor such as the cover open/close sensor 600 to detect whether the guide cover is open or close relative to the first sheet guide. As described above in Variation 2, according to this aspect, the guide cover can be opened to facilitate removal of jammed sheets from the sheet reversing section such as the sheet reversing section 80. Additionally, detecting the open state of the guide cover with the guide cover sensor is advantageous in that the sheet conveying operation can be inhibited by inhibiting print start. Although paper jam may be caused if the sheet is fed to the sheet reversing section with the guide cover being kept open, this control operation can prevent the occurrence of such paper jam.

Aspect M

In Aspect L, in an operation such as double-side printing that involves sheet feeding to the sheet reversing section, the guide cover sensor (e.g., the cover open/close sensor 600) detects whether the guide cover (e.g., the reversing-tray cover 83) is open or closed. When the guide cover sensor detects the guide cover being open before the sheet is fed to the sheet reversing section, sheet feeding is inhibited by, for example, inhibiting print start. As described above in Variation 2, although paper jam may be caused if the sheet is fed to the sheet reversing section with the guide cover being kept open, this control operation can prevent the occurrence of such paper jam.

Aspect N

In Aspect L or M, in an operation such as single-side printing that does not involve sheet feeding to the sheet reversing section, sheet feeding is executed regardless of whether the guide cover (e.g., the reversing-tray cover 83) is open or closed. As described above in Variation 2, this aspect can avoid unnecessary stop of sheet conveyance in the operation that does not relate to the sheet reversing section.

Aspect O

An image forming apparatus includes an image forming device (e.g., the photoconductor drum 10, the charging device 8, the developing device 7, the exposure device 9, and the transfer roller 20) to form an image on a sheet and the sheet stacker according to any one of Aspects A through O to stack the sheet on the sheet stack table. With this aspect, as described, the reversed sheet is inhibited from disturbing the alignment of the sheet stacked on the sheet stack table and pushing the stacked sheet out the sheet stack table.

The above-described embodiments are illustrative and do not limit the present: invention. Thus, numerous additional modifications and variations are possible in light of the above teachings. For example, elements and/or features of different illustrative embodiments may be combined with each other and/or substituted for each other within the scope of the present invention.

What is claimed is:

1. A sheet stacker comprising:

a sheet stack table on which a sheet is stacked; and a sheet reversing section disposed above the sheet stack table, the sheet reversing section defining a sheet reverse passage to reverse a direction of conveyance of a sheet fed to the sheet reversing section, the sheet reversing section including:

a first sheet guide to guide a bottom face of the sheet; and a second sheet guide disposed downstream from the first sheet guide in a sheet conveyance direction in which the sheet is fed to the sheet reversing section, the second sheet guide attachable to and removable from an apparatus body, the second sheet guide to guide the bottom face of the sheet;

an ancillary guide to move between a first position contained inside the first sheet guide and a second position downstream in the sheet conveyance direction from a downstream end of the first sheet guide;

wherein the ancillary guide guides the bottom face of the sheet at the second position.

2. The sheet stacker according to claim 1, the second sheet guide is attachable to and removable from the apparatus body when the ancillary guide is at the first position.

3. The sheet stacker according to claim 1, wherein a sheet-opposing face of the ancillary guide to oppose the sheet has a ragged shape.

4. An image forming apparatus comprising the sheet stacker according to claim 1.

* * * * *